US011777239B2

(12) United States Patent
Sapozhnikov et al.

(10) Patent No.: US 11,777,239 B2
(45) Date of Patent: Oct. 3, 2023

(54) TWINAXIAL CABLE PORT STRUCTURE COUPLED TO AN INTEGRATED CIRCUIT SOCKET

(71) Applicant: Cisco Technology, Inc., San Jose, CA (US)

(72) Inventors: Mike Sapozhnikov, San Jose, CA (US); Sayed Ashraf Mamun, San Jose, CA (US); Tomer Osi, Rosh Ahayin (IL); Amendra Koul, San Francisco, CA (US); David Nozadze, San Jose, CA (US); Upendranadh R. Kareti, Union City, CA (US); Joel R. Goergen, Soulsbyville, CA (US)

(73) Assignee: Cisco Technology, Inc., San Jose, CA (US)

( * ) Notice: Subject to any disclaimer, the term of this patent is extended or adjusted under 35 U.S.C. 154(b) by 4 days.

(21) Appl. No.: 17/653,466

(22) Filed: Mar. 4, 2022

(65) Prior Publication Data

US 2022/0360005 A1 Nov. 10, 2022

Related U.S. Application Data

(60) Provisional application No. 63/201,678, filed on May 7, 2021.

(51) Int. Cl.
*H01R 12/75* (2011.01)
*H01R 12/72* (2011.01)

(52) U.S. Cl.
CPC ..... *H01R 12/727* (2013.01); *H01R 12/75* (2013.01)

(58) Field of Classification Search
CPC ..... H01R 12/727; H01R 12/75; H05K 2201/10356
See application file for complete search history.

(56) References Cited

U.S. PATENT DOCUMENTS

| | | | | |
|---|---|---|---|---|
| 9,011,177 | B2 * | 4/2015 | Lloyd | H01B 11/00 439/607.47 |
| 10,367,280 | B2 * | 7/2019 | Lloyd | H01R 12/75 |
| 2003/0129879 | A1 | 7/2003 | Casey | |
| 2017/0194744 | A1 | 7/2017 | Guetig et al. | |
| 2017/0346234 | A1 | 11/2017 | Girard, Jr. | |
| 2019/0245288 | A1 | 8/2019 | Lloyd et al. | |
| 2021/0091496 | A1 | 3/2021 | Cartier, Jr. et al. | |

OTHER PUBLICATIONS

"Off-the-Shelf Cable Assemblies." Molex, Year: 2022, pp. 1-14 https://www.molex.com/molex/products/family/discrete_offtheshelf.
"Amphenol: Enabling the Electronics Revolution" Dated Aug. 17, 2021, pp. 1-7 https://www.amphenol-icc.com/media/wysiwyg/files/documentation/datasheet/general/amphenol_generic_brochure.pdf.

* cited by examiner

*Primary Examiner* — Vanessa Girardi
(74) *Attorney, Agent, or Firm* — Patterson + Sheridan, LLP

(57) ABSTRACT

Certain aspects of the present disclosure provide techniques for pinless interconnect for twinaxial cables to an IC. This includes a socket coupled to an integrated circuit (IC), a port structure coupled to the socket, and a ground connector inserted into the port structure. It further includes a twinaxial cable including a pair of conductors inserted through the ground connector to establish an electrical connection between the twinaxial cable and the IC.

20 Claims, 22 Drawing Sheets

270

TWINAXIAL CABLE PORT STRUCTURE COUPLED TO AN INTEGRATED CIRCUIT SOCKET

CROSS-REFERENCE TO RELATED APPLICATIONS

This application claims benefit of U.S. provisional patent application Ser. No. 63/201,678 filed May 7, 2021. The aforementioned related patent application is herein incorporated by reference in its entirety.

TECHNICAL FIELD

Embodiments presented in this disclosure generally relate to integrated circuit (IC) packaging. More specifically, one or more embodiments disclosed herein relate to a pinless interconnect for twinaxial ("twinax") cables to an IC.

BACKGROUND

As the industry is driving to achieve higher bandwidth solutions (e.g., 51 terabytes per second and beyond) for IC data transfer, termination of cabling directly to an IC package substrate is becoming increasingly important. For example, twinax cabling is becoming common in modern very-short-range high-speed differential signaling applications. Twinax cabling is similar to coaxial cable, except it includes two inner conductors instead of the one inner conductor in coaxial cable. Terminating twinax cabling directly to an IC package could provide a very high density solution, with strong performance in terms of loss, reflections and crosstalk, but this is a challenging problem.

BRIEF DESCRIPTION OF THE DRAWINGS

So that the manner in which the above-recited features of the present disclosure can be understood in detail, a more particular description of the disclosure, briefly summarized above, may be had by reference to embodiments, some of which are illustrated in the appended drawings. It is to be noted, however, that the appended drawings illustrate typical embodiments and are therefore not to be considered limiting; other equally effective embodiments are contemplated.

To facilitate understanding, identical reference numerals have been used, where possible, to designate identical elements that are common to the figures. It is contemplated that elements disclosed in one embodiment may be beneficially used in other embodiments without specific recitation.

DESCRIPTION OF EXAMPLE EMBODIMENTS

Overview

Figure 1A:
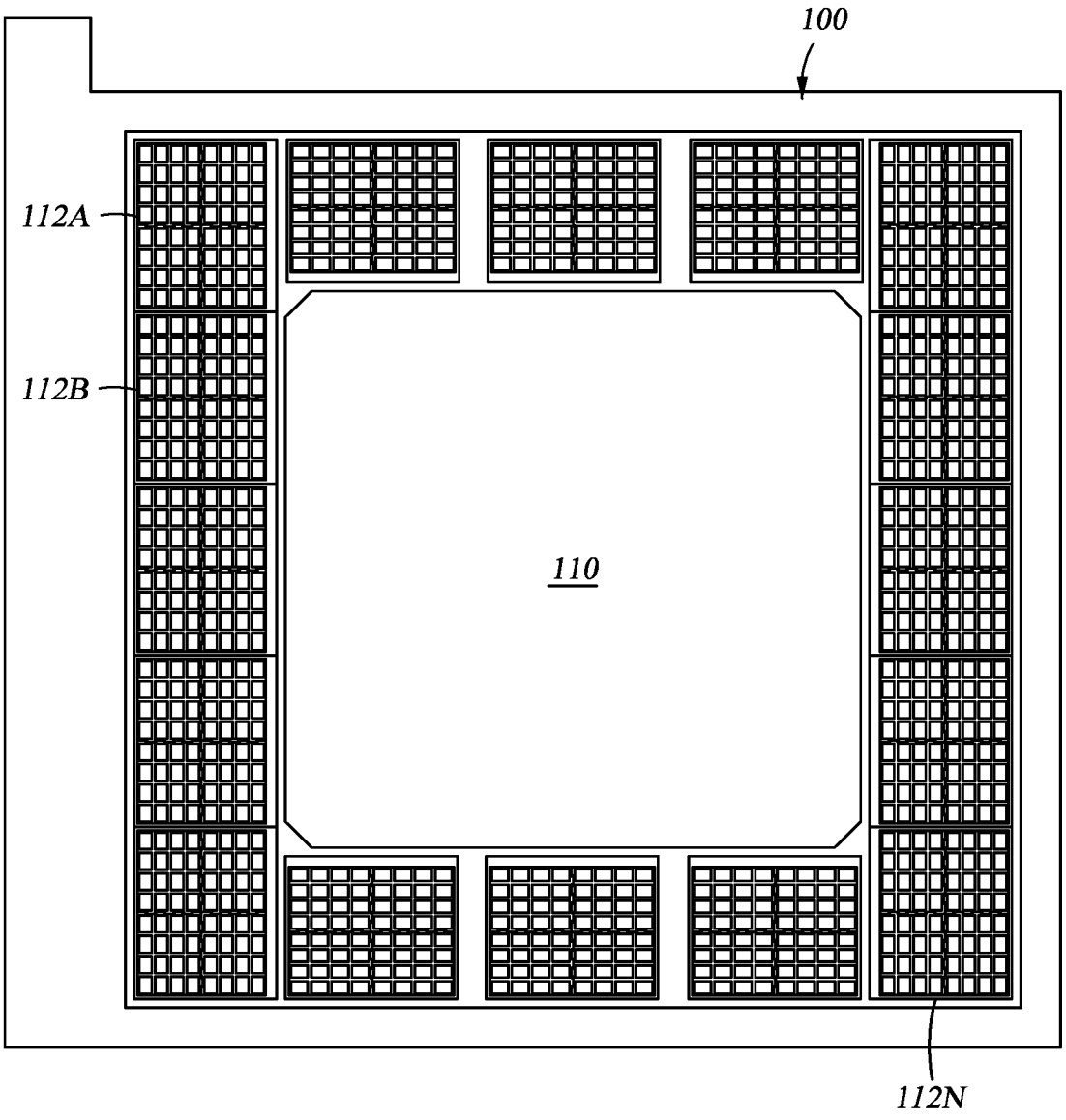
FIGS. 1A-B illustrate an IC package including twinax cables connected to the IC using a pinless interconnect, according to one embodiment.

Embodiments include a system. The system includes a socket coupled to an integrated circuit (IC). The system further includes a port structure coupled to the socket, and a ground connector inserted into the port structure. The system further includes a twinaxial cable comprising a pair of conductors inserted through the ground connector to establish an electrical connection between the twinaxial cable and the IC.

Embodiments further include a method. The method includes inserting a ground connector into a port structure and inserting a twinaxial cable into the ground connector, where the twinaxial cable includes a pair of conductors passing through the ground connector and the port structure. The method further includes coupling the pair of conductors to a socket for an integrated circuit using the port structure, where the coupled pair of conductors provides an electrical connection between the twinaxial cable and the IC.

Embodiments further include an apparatus. The apparatus includes a port structure, where the port structure is configured to be coupled to a socket for an integrated circuit (IC). The apparatus further includes a ground connector inserted into the port structure, where the ground connector includes a receptacle configured to receive a twinaxial cable and one or more openings configured to allow a pair of conductors for the twinaxial cable to pass through the ground connector to establish an electrical connection for the twinaxial cable.

Example Embodiments

One or more embodiments disclosed herein describe terminating a twinax cable pod (e.g., a grouping of twinax cables) directly into a socket (e.g., a land grid array (LGA) type socket) soldered to an IC package substrate. For example, as discussed below in relation to FIGS. 1A-6B, a high density interconnect can include pinless termination for twinax cables. Further, in an embodiment, the interconnect can include a strain relief structure (e.g., to alleviate pistoning), as discussed below in relation to FIG. 4C, and modularization of twinax pods (e.g., as discussed below in relation to FIGS. 2A-D).

For example, each twinax pod can be modularized to align with quad (e.g., 4-channel) small form-factor pluggable-double density (QSFP-DD) connectors, or other suitable connector types. This can facilitate manufacturing testing and reduce material impact for units that fail. As one example, an individual faulty port (e.g., identified during manufacturing testing) can be replaced, as opposed to multiple ports. Further, in an embodiment, the interconnect can interface the IC to any suitable connector, including a QSFP-DD connector, an octal small form factor pluggable (OSFP) connector, an orthogonal direct connector, or any other suitable connector.

In an embodiment, one or more of the disclosed techniques can provide a twinax interconnect that is tuned to reduce discontinuity and increase density. For example, using one or more these techniques 1024 serializer/deserializer (SerDes) lanes can be achieved in a 91 mm^2 area. As another example, both sides of an IC package substrate can be used to expand the SerDes lane count to 2048. Further, in an embodiment, a twinax interconnect or co-package optics can be connected to an IC using the same techniques (e.g., as discussed above), achieving extremely high density.

One or more embodiments are described herein in the context of twinax cables. This is merely one example. These techniques can further be used with other coaxial cables (e.g., triax cables, quadrax cables, or any other suitable coaxial cable), or any other suitable type of cable (e.g., a suitable high speed cable).

Figure 1B:
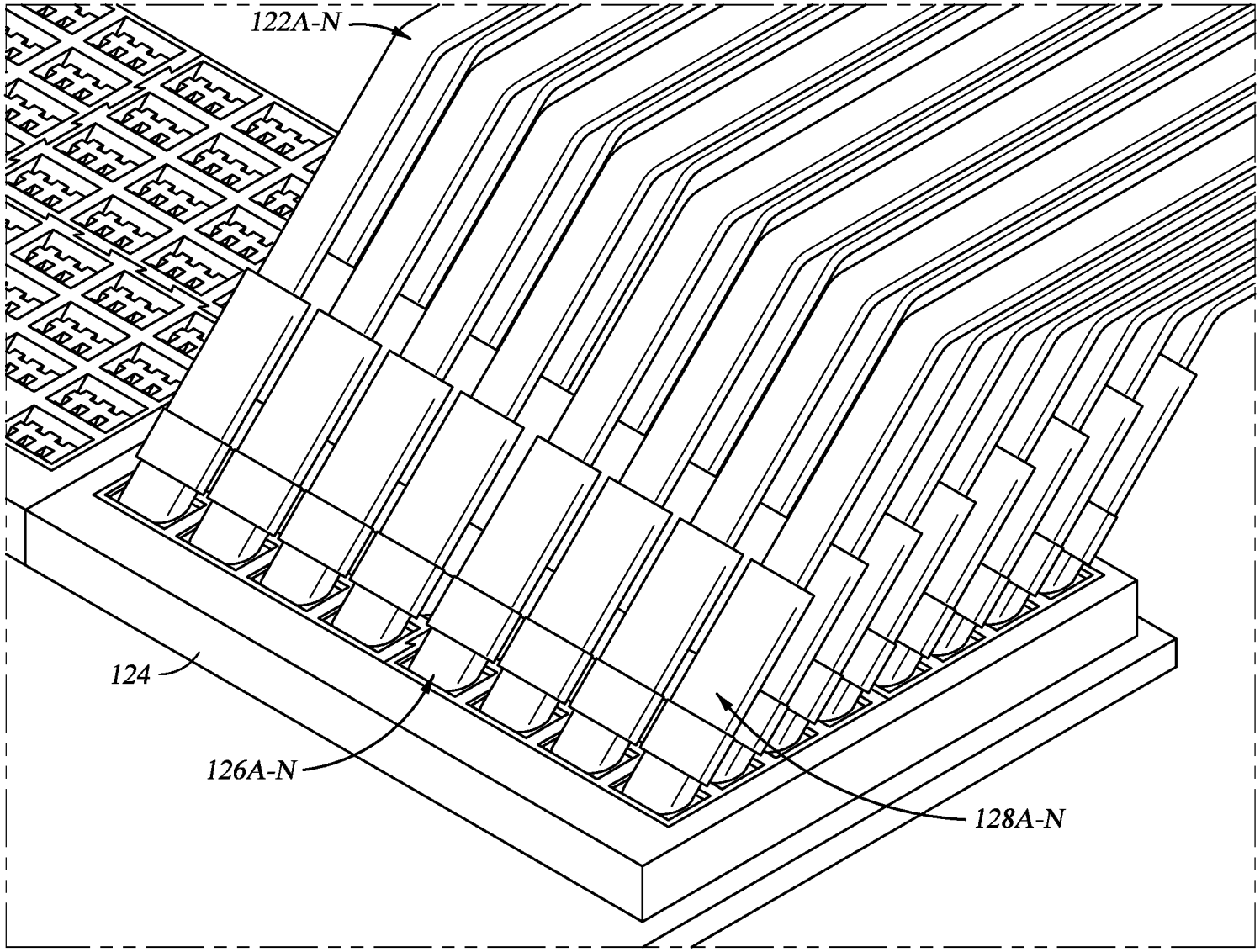

FIGS. 1A-B illustrate an IC package including twinax cables connected to the IC using a pinless interconnect, according to one embodiment. In an embodiment, an IC package 100 includes a die 110 and a number of cable connector sockets 112A-N. For example, the IC package 100 can have an area of 91 $mm^2$ (e.g., 91 mm in each dimension), and the die 110 can have dimensions of 34 mm by 41 mm. These are merely examples, and any suitable dimensions can be used for both the IC package 100 and the die 110.

The cable connector socket 112A can, in an embodiment, be a LGA socket. The cable connector socket 112A can further be coupled to a twinax cable pod 120. In an embodiment, the twinax cable pod 120 includes numerous twinax cables 122A-N connected to a port structure 124 using respective ground connecting structures 126A-N. For example, as discussed further below with regard to FIGS. 2A-2D, the port structure 124 can include a grid of individual port structures (e.g., an individual port for each twinax cable connection). These individual port structures can connect together using a latching system, and are, for example, made out of a suitable insulating material (e.g., a high temperature resistant plastic). This is merely one example, and the port structure 124 can be made up of any suitable material.

In an embodiment, as discussed further below in relation to FIGS. 3A-3G, the ground connecting structures 126A-N can be individual structures configured to be inserted into the port structure 124 to hold the respective twinax cables 122A-N. For example, each respective twinax cable 122A-N can be connected to an individual ground connecting structure 126A-N to hold the twinax cable and provide a connection from the twinax cable to the port structure 124 and the socket 112A. In an embodiment, the ground connecting structures 126A-N are made out of a suitable conducting material (e.g., a metal). This is merely one example, and the ground connecting structures 126A-N can be made up of any suitable material. Further, in an embodiment, the ground connecting structures 126A-N are connected to the port structure 124 at a suitable slanted angle (e.g., an angle of less than 90 degrees relative to the port structure 124).

In an embodiment, as discussed further below in relation to FIGS. 4A-B, the twinax cables 122A-N can be individually connected to the port structure 124 using the ground connecting structures 126A-N. Further, each of the twinax cables 122A-N can connect to the respective ground connecting structure 126A-N using a cable strain relief structure 128A-N. This is discussed further below with regard to FIG. 4C.

Figure 2A:
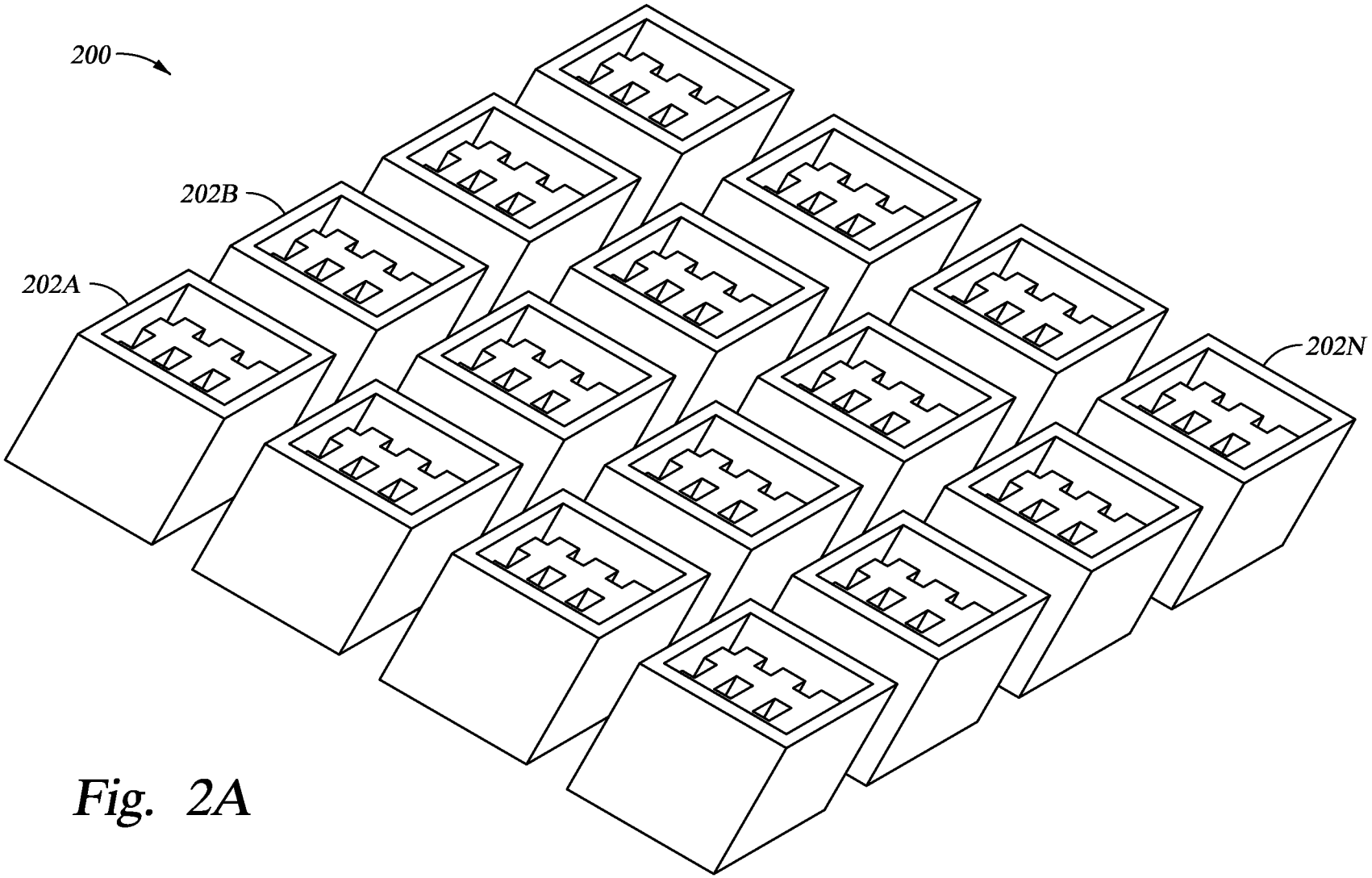
FIG. 2A-D illustrate port structures for connecting twinax cables to an IC using a pinless interconnect, according to one embodiment.

FIG. 2A illustrates port structures for connecting twinax cables to an IC using a pinless interconnect, according to one embodiment. In an embodiment, a port structure 200 includes numerous individual ports 202A-N. Each port is configured to receive a ground connecting structure (e.g., as discussed below in relation to FIGS. 3A-G), and each ground connecting structure can hold a twinax cable.

In an embodiment, the ports 202A-N are connected together to form a grid. For example, 16 ports 202A-N can be connected together to form a 4×4 grid, making up one section of a pinless twinax interconnect. Each port 202A-N can be made of a suitable plastic material (e.g., a high temperature resistant plastic) and can have a footprint of approximately 1.5 mm×2 mm, and a height of approximately 1 mm. Further, each port can include openings on both a top and bottom side, to allow a ground connecting structure to connect through the port to a socket underneath (e.g., to allow an electrical connection or an optical connection). A twinax cable can connect to the socket using a given ground connecting structure and port. This is discussed further below with regard to FIGS. 5A-D.

Figure 2B:
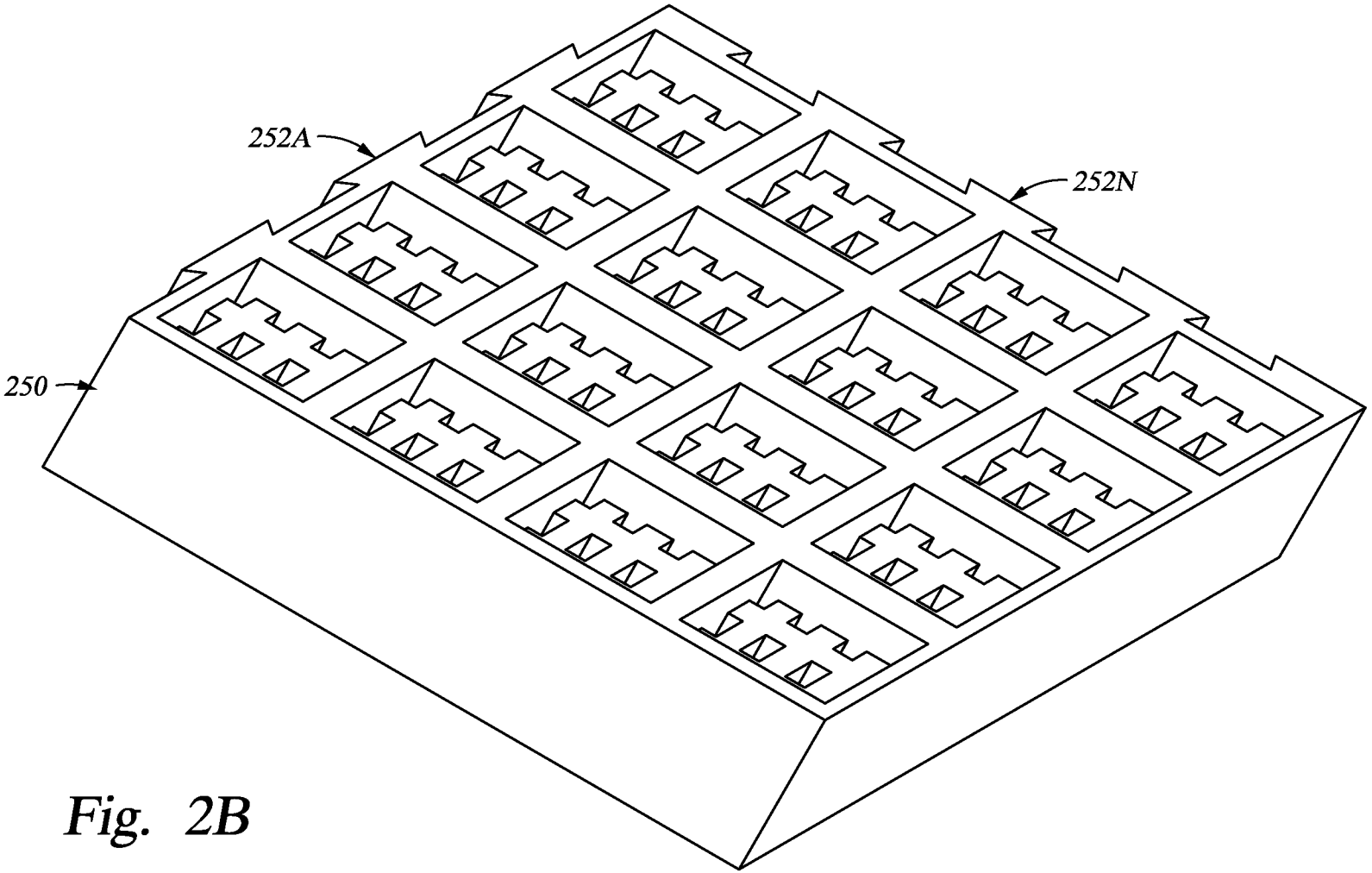
Figure 2C:
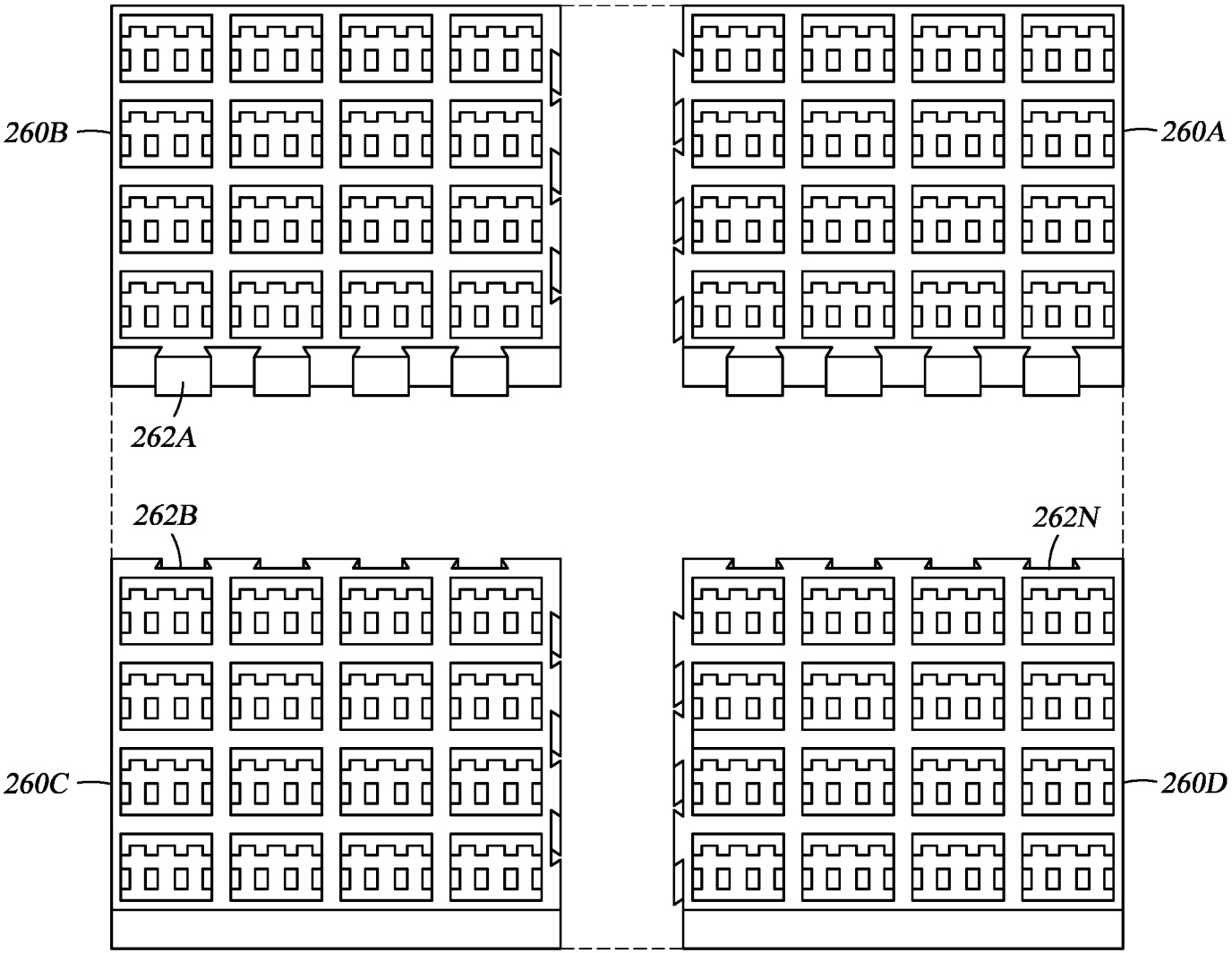
Figure 2D:
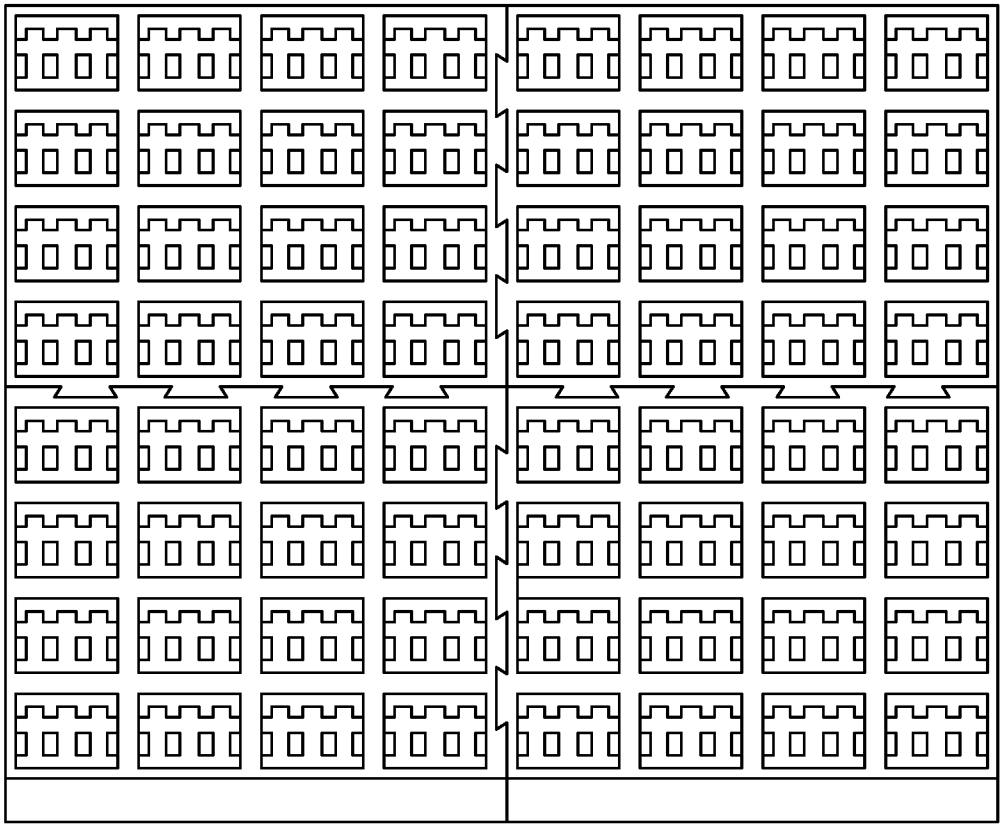

FIGS. 2B-D illustrate latching port structures for connecting twinax cables to an IC using a pinless interconnect, according to one embodiment. In an embodiment, a port structure 250 includes latching structures 252A-N. These latching structures 252A-N can be used to connect multiple port structures (e.g., multiple grids of ports). For example, four port structures 260A-D can connect together to form a pinless interconnect 270 (e.g. an interconnect in which twinax cables connect to the port structures without use of a pin). Each port structure 260A-D can include respective latching structures 262A-N. These latching structures 262A-N can latch together (e.g., by connecting male and female portions of the latching structures) to form the pinless interconnect 270.

FIGS. 3A-D illustrate a ground connecting structure for connecting twinax cables to an IC using a pinless interconnect, according to one embodiment. In an embodiment, a ground connecting structure 310 is configured to connect with a port structure 250. FIGS. 3A-D illustrate the ground connecting structure 310 when it is not connected to the port structure 250. The ground connecting structure 310 includes a number of teeth 312 and a receptacle 360. In an embodiment, the ground connecting structure 310 is inserted into a port in the port structure 250 and serves multiple purposes. For example, the ground connecting structure 310 can provide structural support for a twinax cable inserted into a port in the port structure 250, can provide strain relief to the the twinax cable, and can provide a ground connection for the twinax cable (e.g., between a conducting shield in the twinax cable and a conducting portion of the ground connecting structure 310). This is discussed in more detail below in relation to FIGS. 4A-C.

Figure 3A:
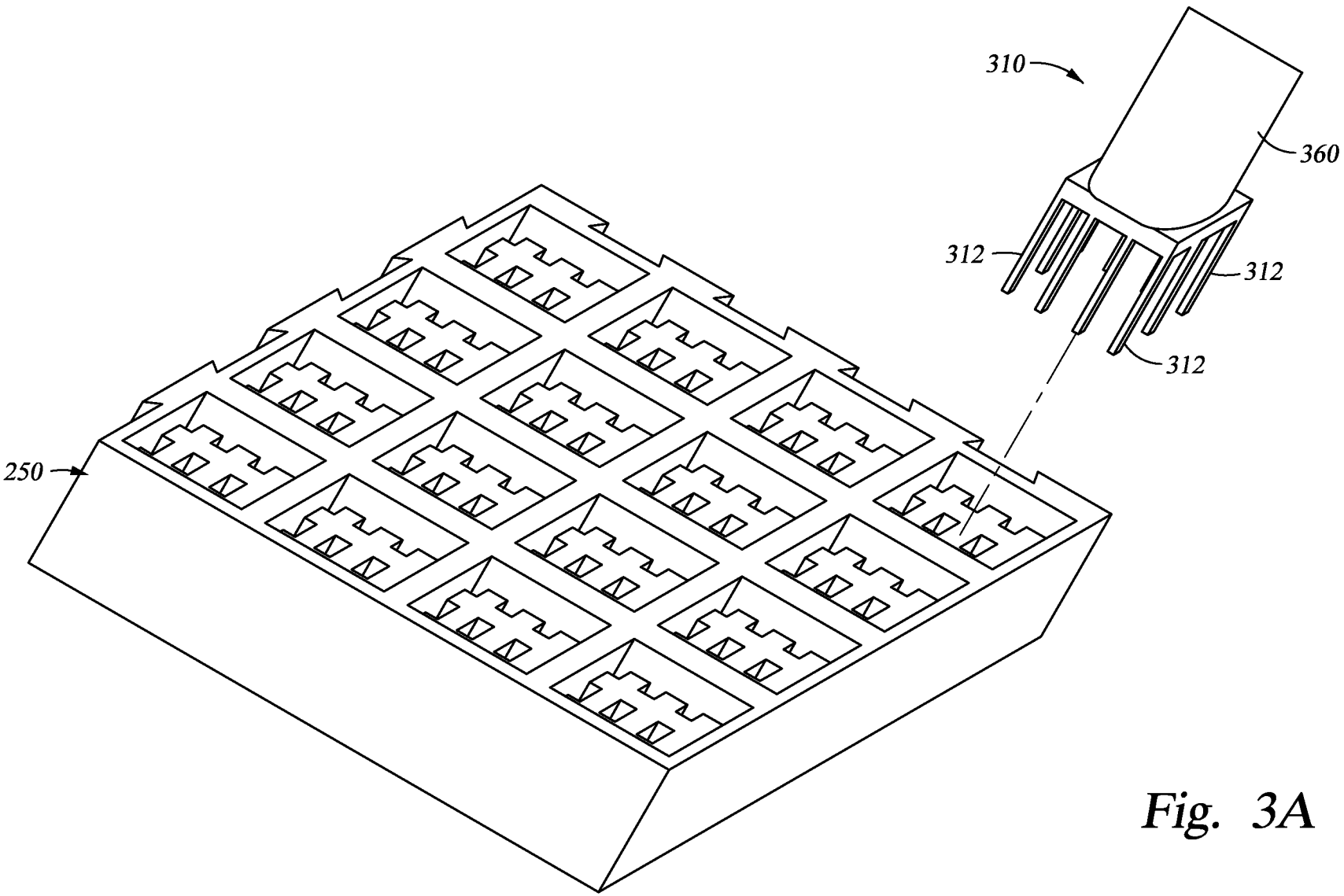
FIGS. 3A-G illustrate connection of a twinax cable to an IC using a ground connecting structure for pinless interconnect, according to one embodiment.
Figure 3B:
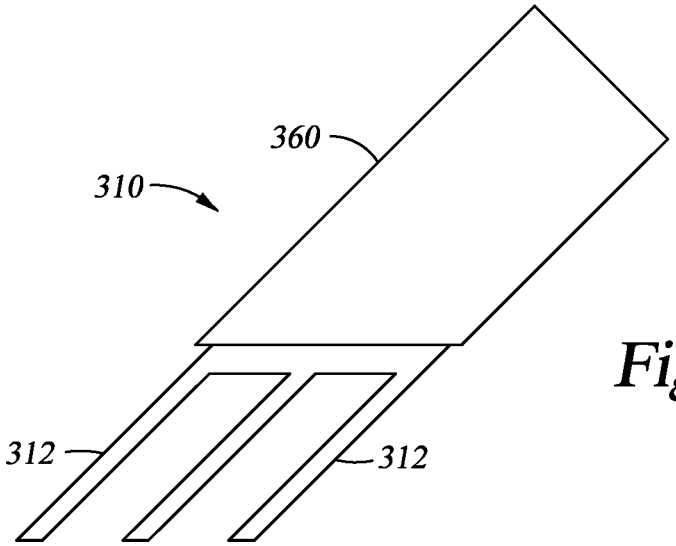
Figure 3C:
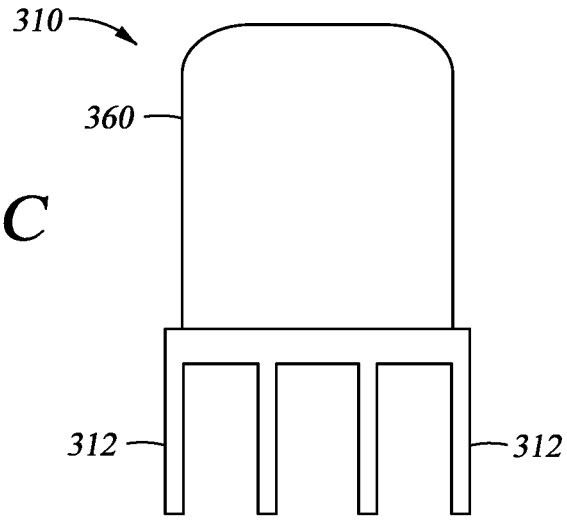
Figure 3D:
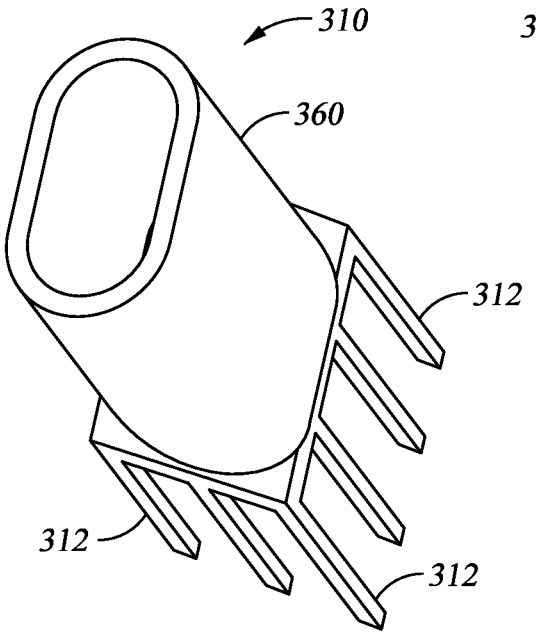

As illustrated, FIGS. 3B-D provide additional viewpoints for the ground connecting structure 310. FIG. 3B provides a side view of the ground connecting structure, including teeth 312 and a receptacle 260. FIG. 3C provides a frontal view of the ground connecting structure, including teeth 312 and a receptacle 360. FIG. 3D provides a top down view of the ground connecting structure, including teeth 312 and a receptacle 360.

In an embodiment, the port structure 250, the ground connecting structure 310, or both, can vary in size to accommodate different pitches and sizes of cable. For example, openings in the port structure 250, the ground connecting structure 310, or both, can vary in distance to accommodate different pitches (e.g., different dimensions between conductors in twinax cables). As another example, the outer dimensions of the port structure 250, the ground connecting structure 310, or both, can vary to accommodate different gauges (e.g., different thicknesses) of twinax cables.

Figure 3E:
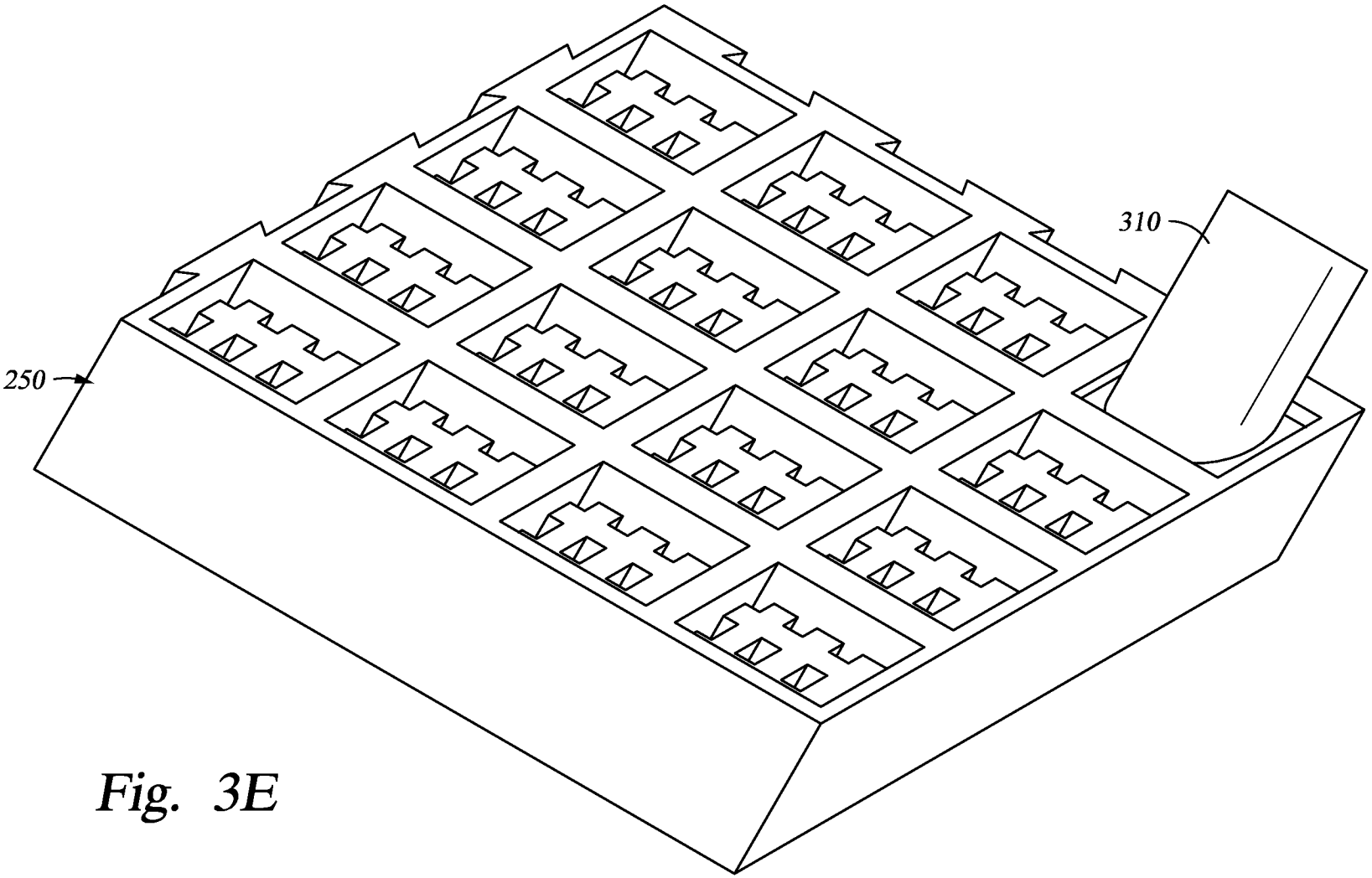
Figure 3F:
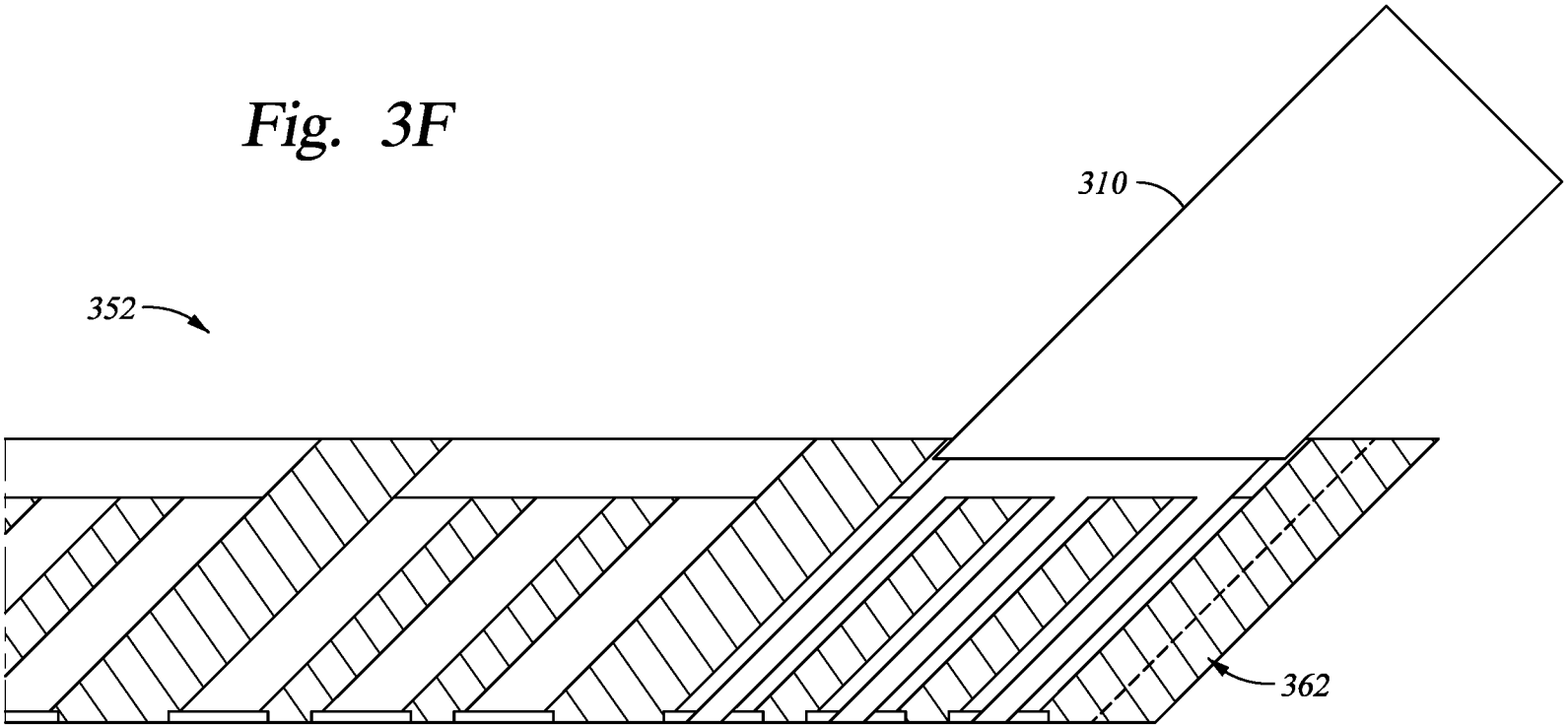
Figure 3G:
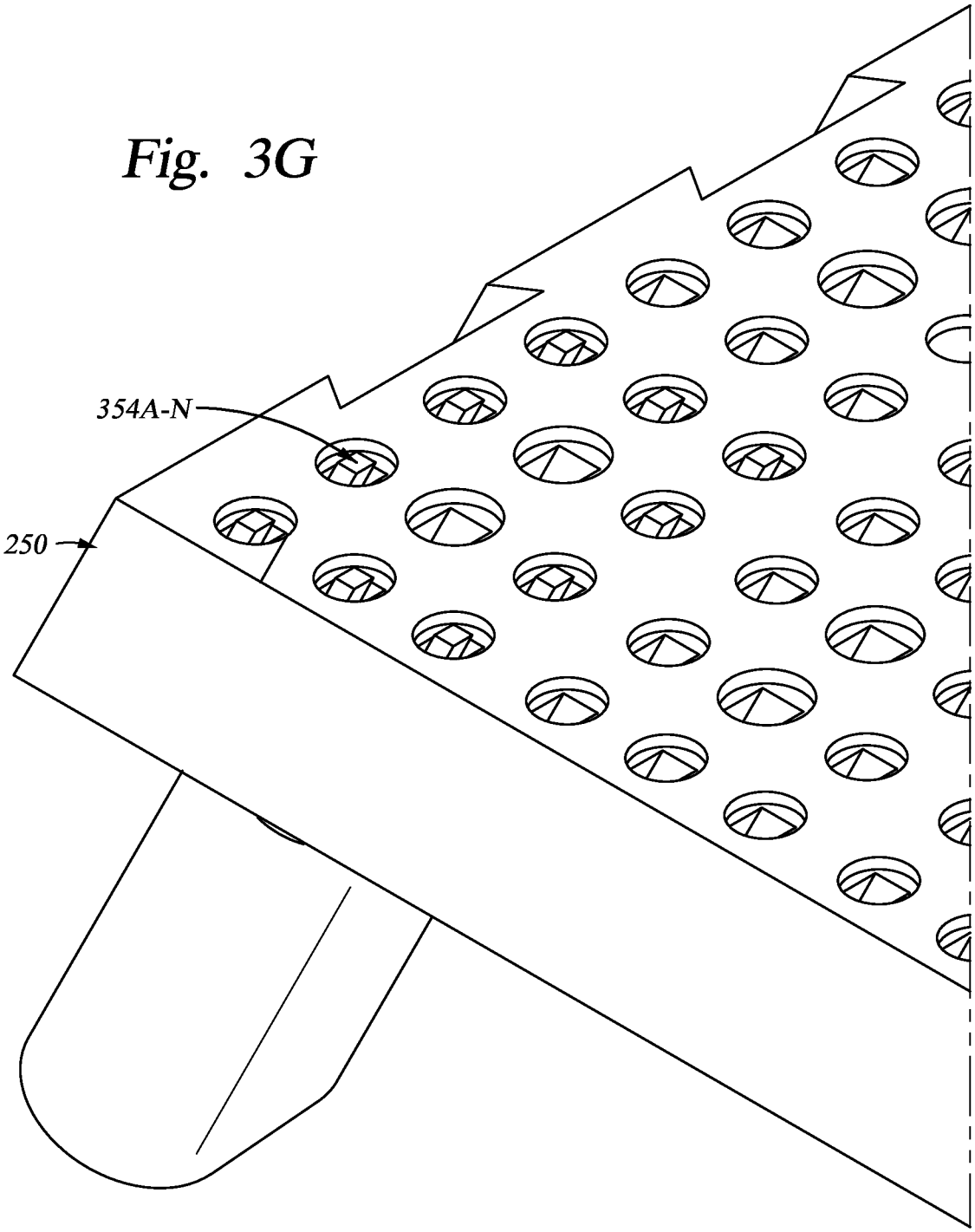

FIGS. 3E-G illustrates connection of a twinax cable to an IC using a ground connecting structure for pinless interconnect, according to one embodiment. In an embodiment, FIGS. 3E-G illustrates the ground connecting structure 310 when it is connected with the port structure 250. As illustrated, a view 352 shows an underside of the port structure 250. Multiple teeth 354A-N from the ground connecting structure 310 extend through an opening at the top of the port structure 250 to an opening at the bottom of the port structure 250. As discussed below in relation to FIGS. 6A-C, these teeth 354A-N can provide a connection between a twinax cable connected to the ground connecting structure 310 and an underlying socket (e.g., an electrical connection).

In an embodiment, FIG. 3F depicts the ground connecting structure connected with the port structure 250. For example, FIG. 3F illustrates a side x-ray view of multiple teeth 362 of the ground connecting structure 310 passing through openings in the port structure 250. In an embodiment, the ground connecting structure 310 is connected to the port structure 250 at a suitable slanted angle (e.g., an angle of less than 90 degrees).

Figure 4A:
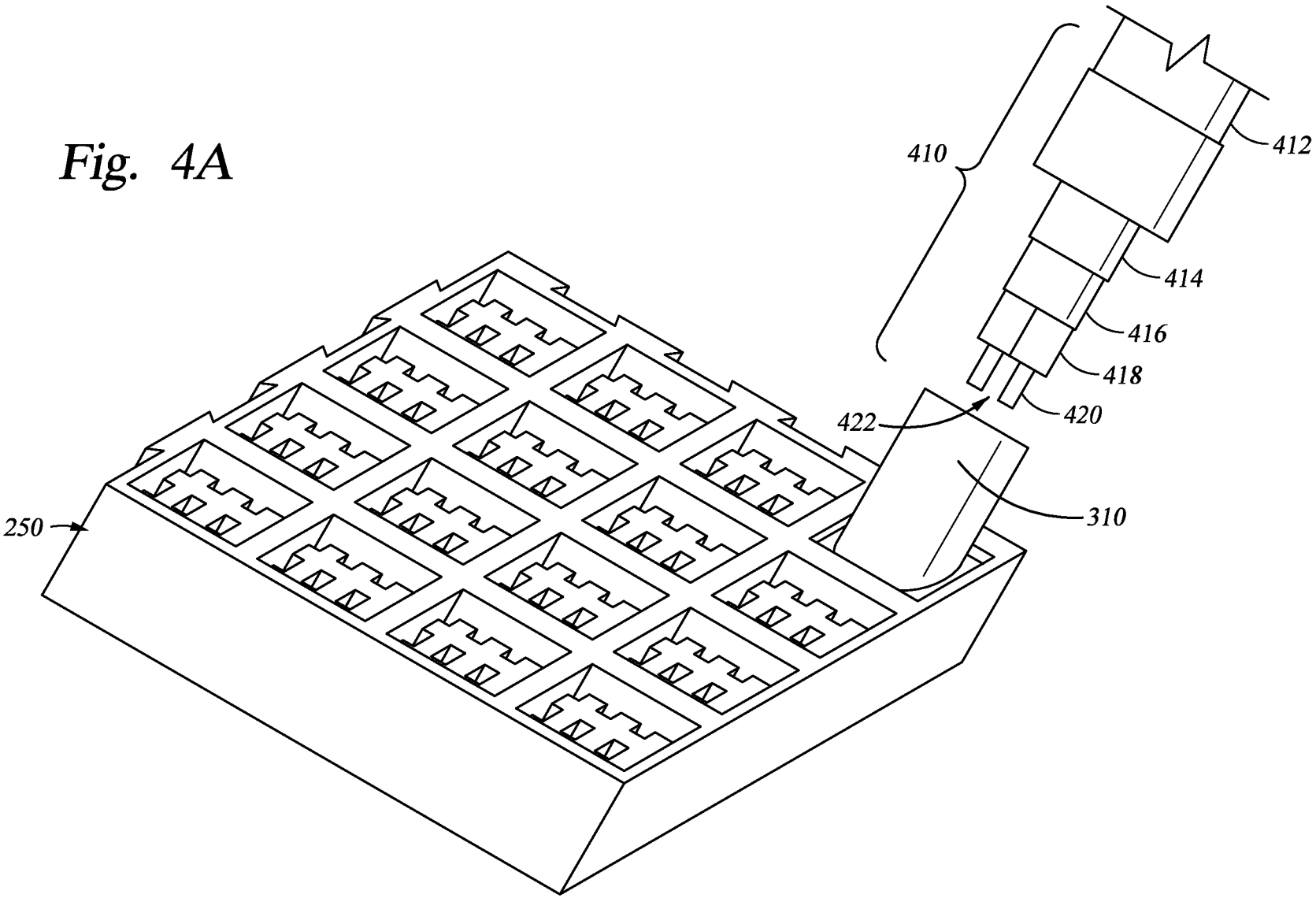
FIGS. 4A-C illustrate a twinax cable structure connecting to a ground connecting structure for pinless interconnect to an IC, according to one embodiment.

FIG. 4A illustrates a twinax cable structure connecting to a ground connecting structure for pinless interconnect to an IC, according to one embodiment. In an embodiment, the ground connecting structure 310 is connected to a port structure 250. The ground connecting structure 310 receives a twinax cable structure 410 (e.g., as illustrated below in relation to FIG. 4B). The twinax cable structure 410 includes a twinax cable jacket 414, a shield 416, an insulator 418, and a pair of conductors 420.

In an embodiment, the pair of conductors 420 carry a data signal (e.g., a differential data signal), and are made up of a suitable conducting material. For example, the conductors 420 can be made up of a suitable metal (e.g., copper). Further, in an embodiment, the pair of conductors are spaced apart at a suitable pitch 422. For example, the conductors 420 can be separated at a pitch of 0.55 mm. This is merely one example, and any suitable pitch can be used. In an embodiment, the ground connecting structure 310 and the port structure 250 include openings spaced apart at a pitch to match the pitch 422 of the conductors 420. The conductors 420 are surrounded by an insulator 418. In an embodiment, the insulator 418 is made up of a suitable dielectric material. The insulators 418 is surrounded by a shield 416. In an embodiment, the shield 416 is made up of a suitable conducting material (e.g., copper or another metal). Further, in an embodiment, the shield 416 can connect to the ground connecting structure 310, to provide a complete ground connection. The shield 416 is surrounded by a twinax cable jacket 414. In an embodiment, the twinax cable jacket 414 is made up of a suitable insulating material (e.g., a plastic or rubber material).

In an embodiment, the twinax cable structure 410 is merely one example of a twinax cable. For example, the twinax cable structure 410 is one example of a drainless twinax cable structure. A wide variety of suitable twinax cable structures can be used, including a drainless twinax cable structure, a twinax cable structure with a drain (e.g., a center drain), a single extrusion twinax cable structure, or a co-extrusion twinax cable structure. Further, in an embodiment, a suitable guide structure could be used for the twinax cable structure 410. For example, a guide structure could be used to assist in keeping the twinax cable structure 410 connected to the ground connecting structure 310.

In an embodiment, the twinax cable structure further includes a strain reliever sleeve 412. For example, the strain reliever sleeve 412 can provide cable strain relief for the twinax cable structure 410 when it is connected to the ground connecting structure 310. This is discussed further below with regard to FIG. 4C.

Figure 4B:
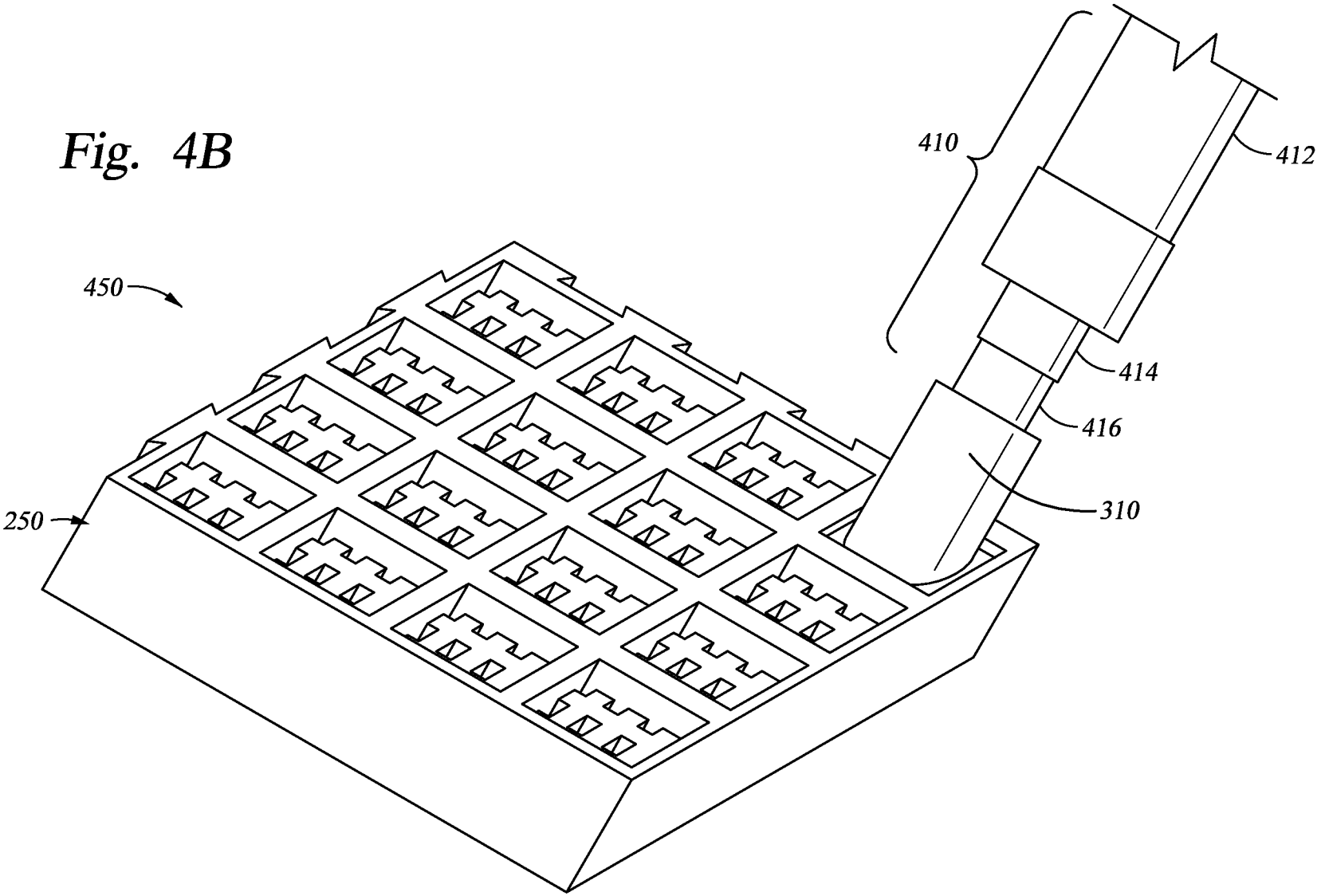

FIG. 4B illustrates a twinax cable structure connected to a ground connecting structure for pinless interconnect to an IC, according to one embodiment. In an embodiment, FIG. 4B provides a view 450 illustrating the twinax cable structure 410 of FIG. 4A connected to the ground connecting structure 310. For example, the conductors 420 illustrated in FIG. 4A are inserted within a receptacle of the ground connecting structure 310 (e.g., the receptacle 360 illustrated above in FIGS. 3A-D).

Figure 4C:
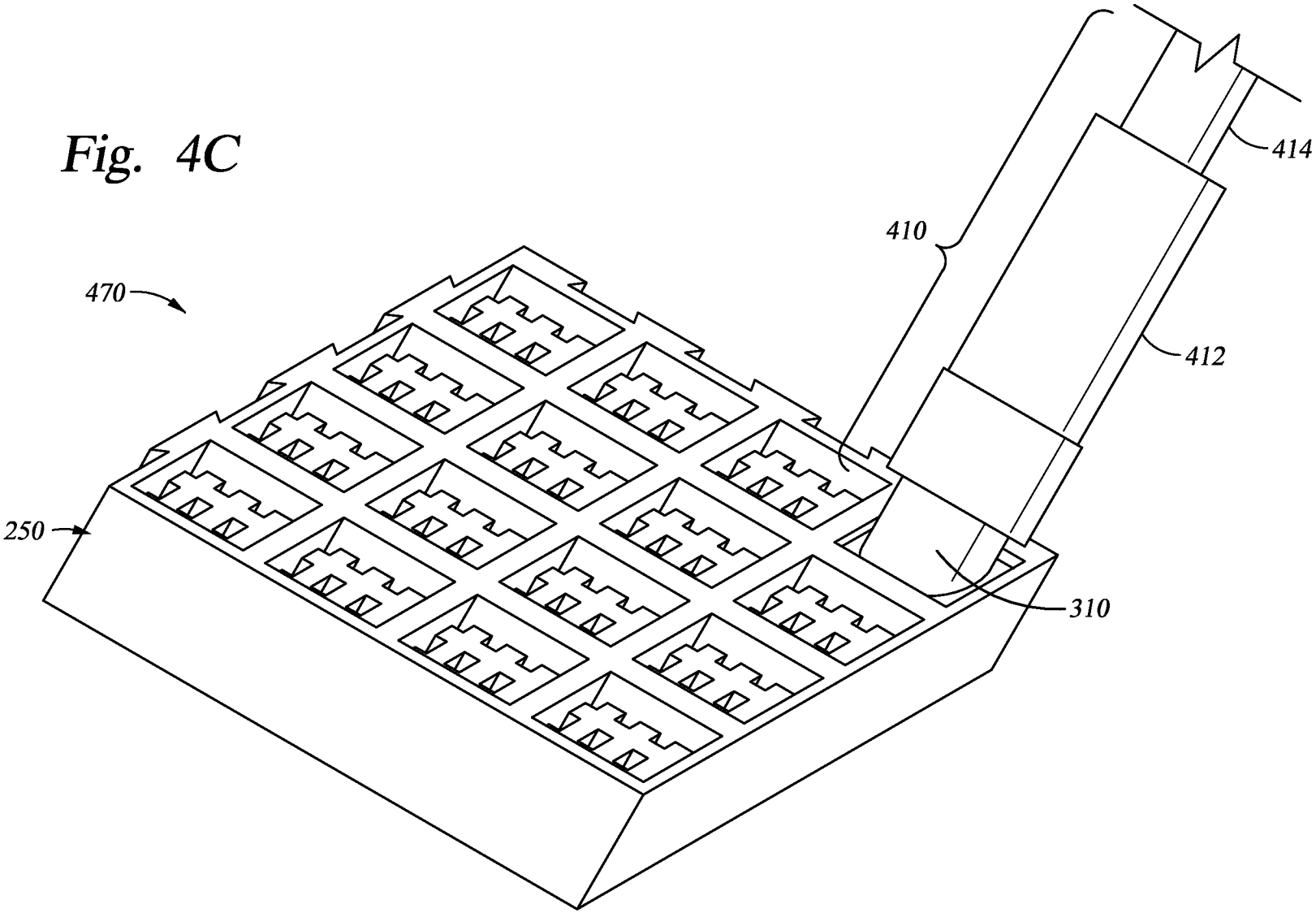

FIG. 4C illustrates twinax cable strain relief for connecting twinax cables to an IC using a pinless interconnect, according to one embodiment. In an embodiment, FIG. 4C provides a view 470 illustrating the twinax cable structure 410 of FIG. 4A connected to the ground connecting structure 310 with a strain reliever sleeve 412. In an embodiment, a twinax cable structure 410 is connected to a ground connecting structure 310. Further, a strain reliever sleeve 412 has been moved down to cover the join where the twinax cable jacket 414 meets the ground connecting structure 310.

In an embodiment, the strain reliever sleeve 412 acts in concert with the ground connecting structure 310 to provide strain relive to reduce (or eliminate) damage to the twinax cable if force is applied to the cable. For example, the twinax cable structure 410 can be thin, and fragile, leaving it vulnerable to force (e.g., pulling) applied to the cable after connection. The conductors (e.g., the conductors 420 illustrated in FIG. 4A), the shield (e.g., the shield 416 illustrated in FIG. 4A), and other components of the twinax cable structure 410 could break or crack. This can be alleviated by a strain reliever, which can include a strain reliever sleeve 412 made of a suitable rubber or plastic material (e.g., a flexible rubber sleeve) and can work in concert with the ground connecting structure 310 to provide strain relief for the cable and avoid damage to the cable.

Figure 5A:
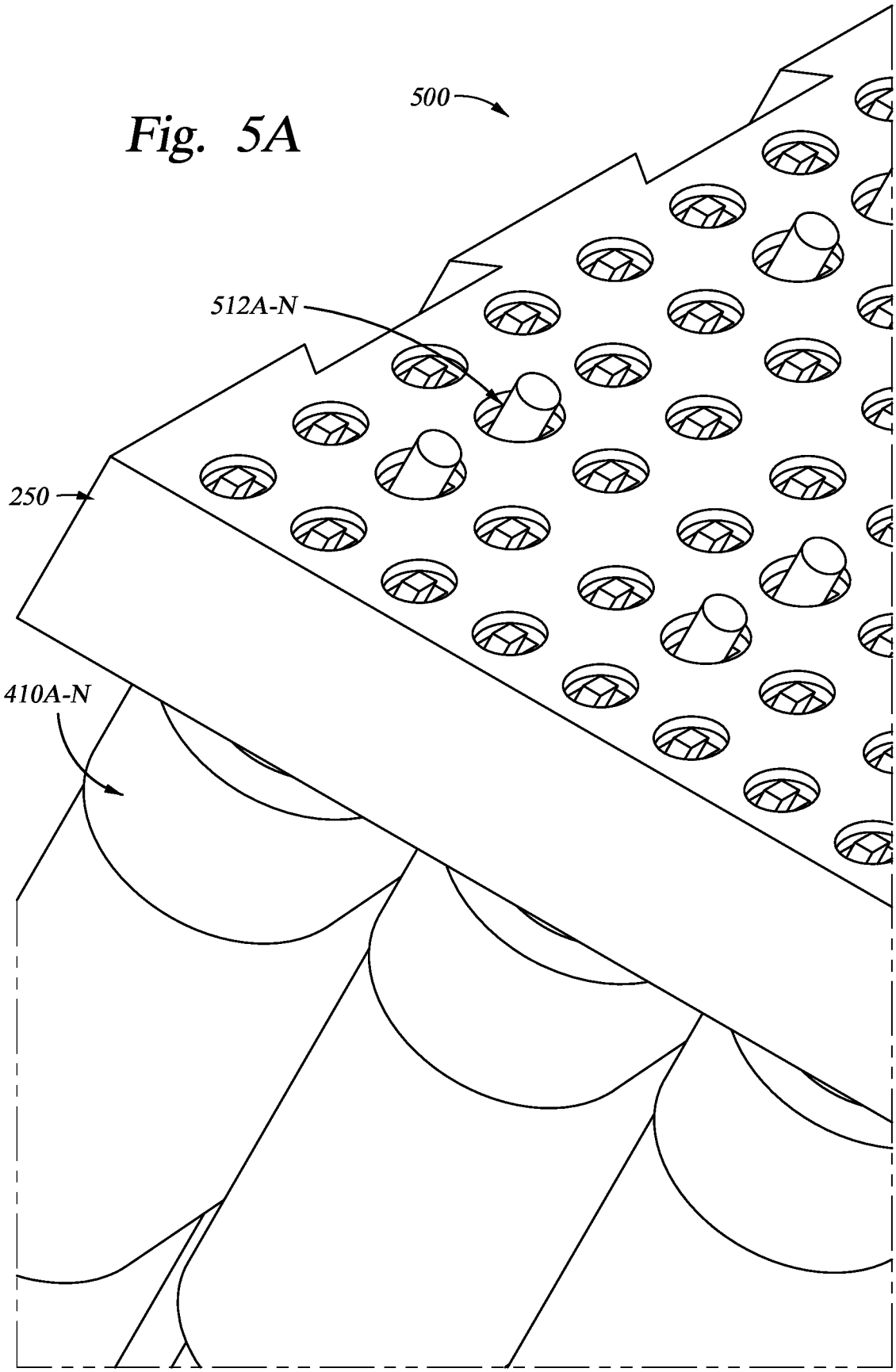
FIG. 5A-D illustrates views of connecting twinax cables to an IC using a pinless interconnect, according to one embodiment.

FIG. 5A illustrates a contact side view of connecting twinax cables to an IC using a pinless interconnect, according to one embodiment. In an embodiment, FIG. 5A illustrates a contact side (e.g., an underside) view 500 of a port structure 250 (e.g., the port structure 250 illustrated in FIGS. 3A-G). A number of twinax cable structures 410A-N (e.g., the twinax cable structure 410 illustrated in FIGS. 4A-C) are connected to a port structure 250.

As illustrated, each twinax cable structure 410A-N includes a pair of conductors (e.g., the conductors 420 illustrated in FIG. 4A) which pass through openings in the ground connecting structures (e.g., the ground connecting structure 310 illustrated in FIGS. 3A-G) and the port structure 250. In an embodiment, each of these conductors passes through the port structure 250, leaving the protruding conductor portions 512A-N.

Figure 5B:
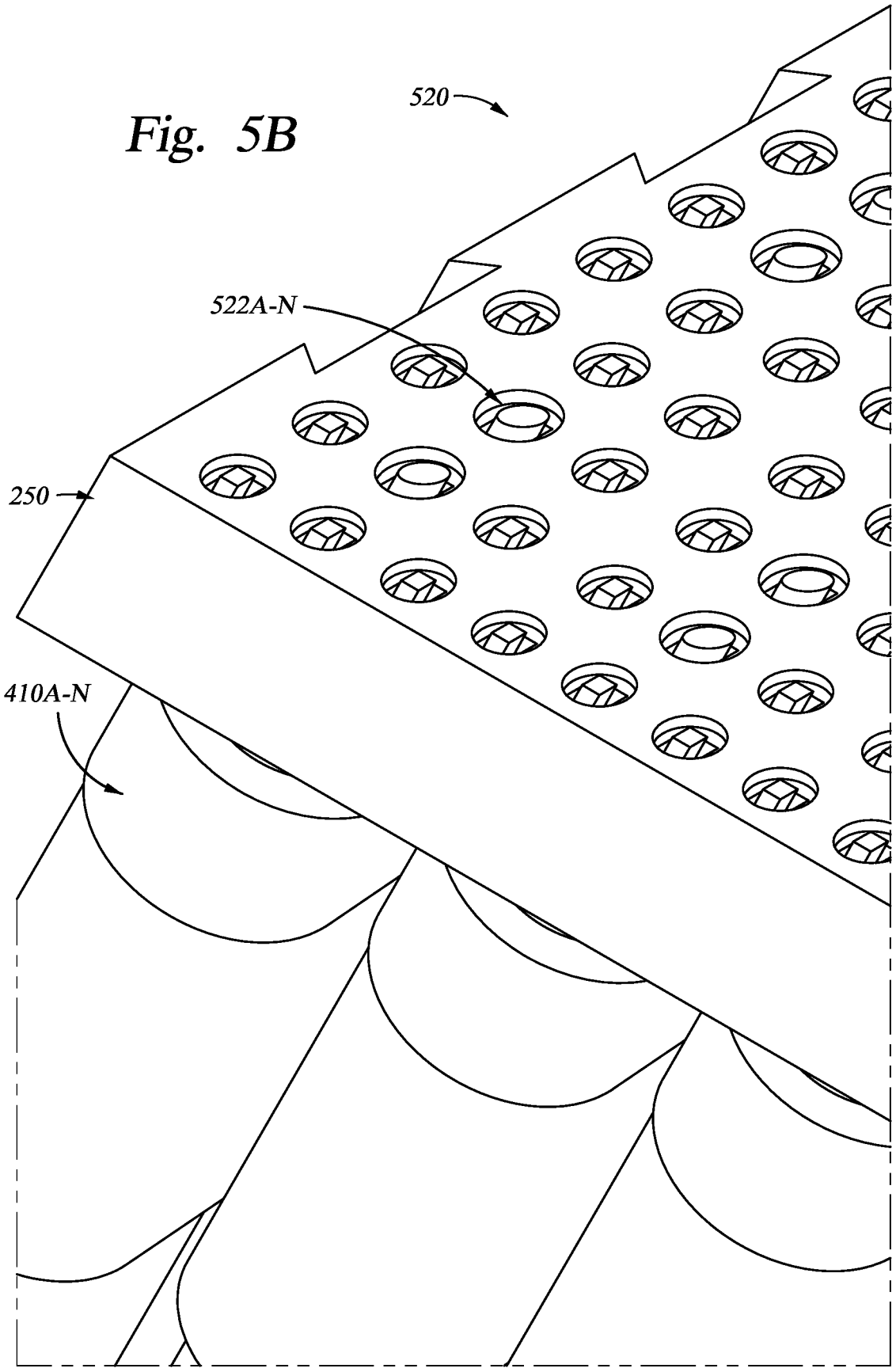

FIG. 5B illustrates a laser cut contact side view 520 of connecting twinax cables to an IC using a pinless interconnect, according to one embodiment. In an embodiment, each of the protruding conductor portions 512A-N illustrated in FIG. 5A can be cut, leaving flush conductor portions 522A-N illustrated in FIG. 5B. For example, the protruding conductor portions can be cut using a laser cutting tool, or any other suitable cutting tool. In an embodiment the flush conductor portions 522A-N are approximately flush with the port structure 250 (e.g., they do not significantly protrude past the port structure 250).

Figure 5C:
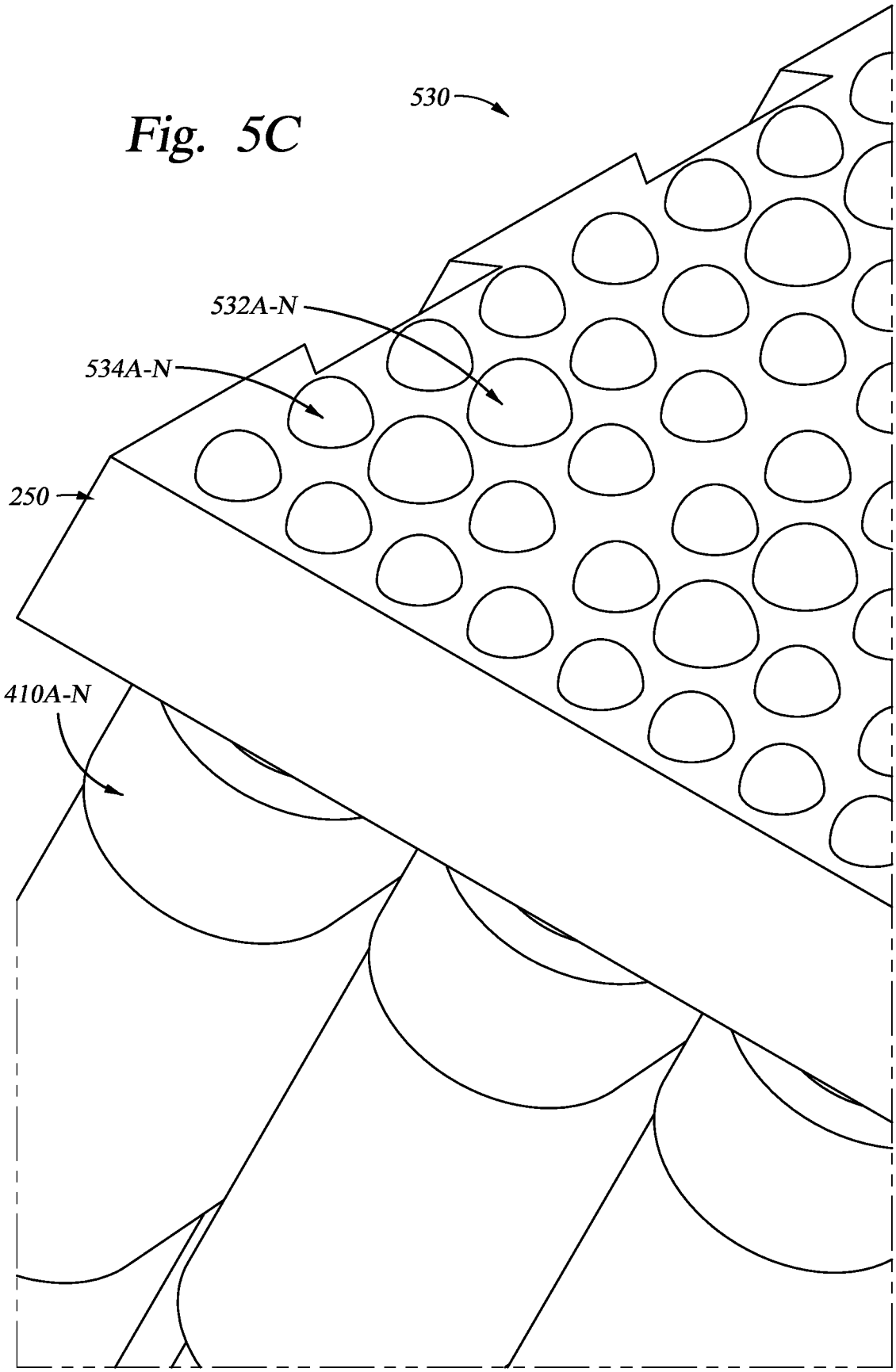

FIG. 5C illustrates a contact side view 530 of metal deposition for connecting twinax cables to an IC using a pinless interconnect, according to one embodiment. In an embodiment, a suitable conducting material (e.g., a metal) can be deposited on the contact side of the port structure 250. This can facilitate a connection (e.g., an electrical connection) between conductors in the twinax cable structures 410A-N and a suitable socket (e.g., the sockets 112A-N illustrated in FIGS. 1A-B) using the port structure 250.

In an embodiment, a number of conductor connections 532A-N (e.g., for the conductors in the twinax cable structures 410A-N) are formed by depositing the conducting material. Further, a number of ground connections 534A-N are formed. The conductor connections 532A-N and ground connections 534A-N can be formed by depositing any suitable conducting material, and any suitable quantity of conducting material. For example, as illustrated the conductor connections 532A-N appear larger than the ground connections 534A-N. This is merely an example, and the ground connections 534A-N can be the same size as the conductor connections 532A-N, or the ground connections 534A-N can be larger than the conductor connections 532A-N. Further, any number, or patter, of ground connections 534A-N can be used.

Figure 5D:
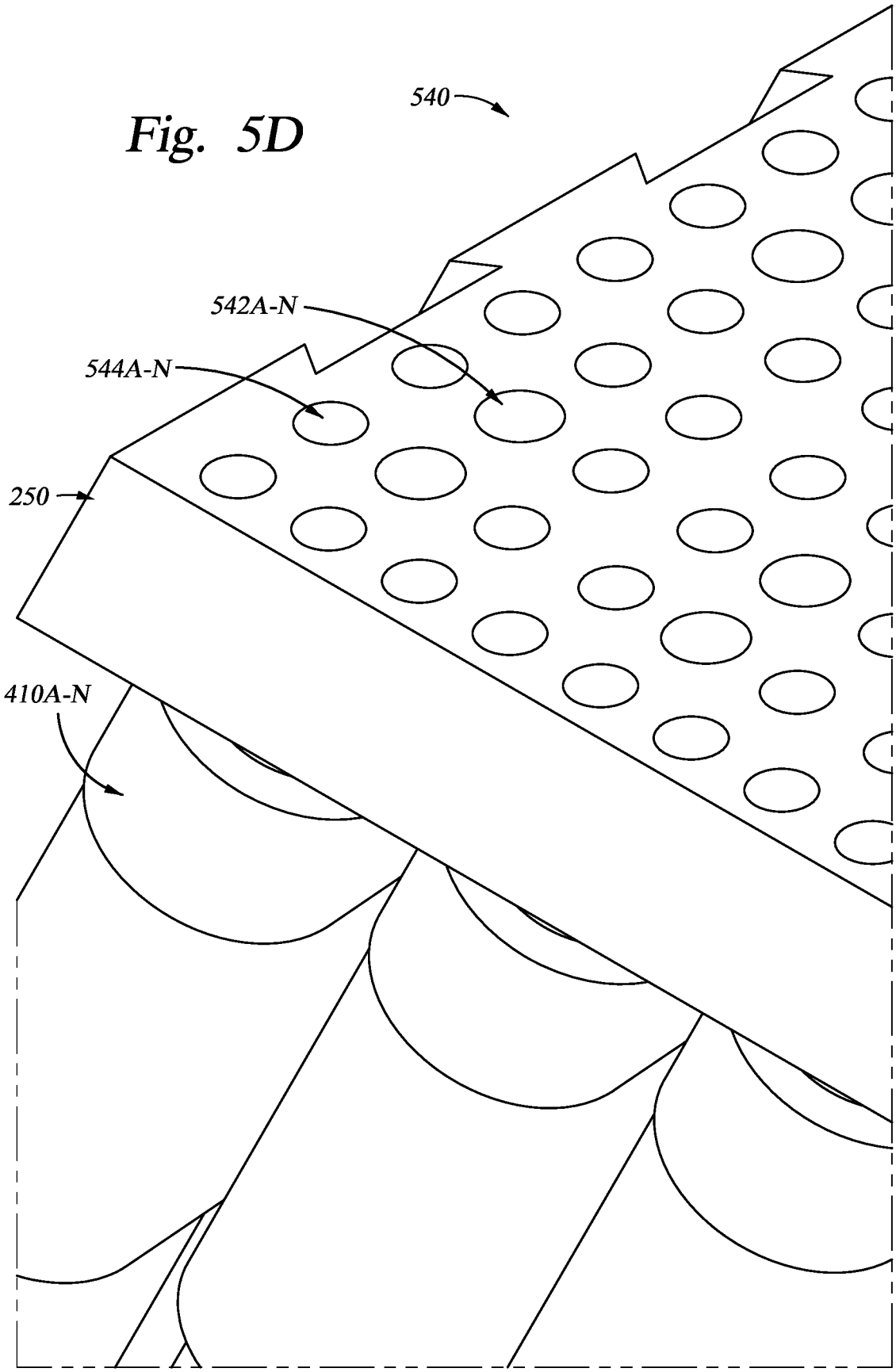

FIG. 5D illustrates a polished contact side view 540 of metal deposition for connecting twinax cables to an IC using a pinless interconnect, according to one embodiment. In an embodiment, conductive material is deposited to form the conductor connections 532A-N and the ground connections 534A-N illustrated in FIG. 4B. This conductive material is ground (e.g., using a grinder) and polished, to form polished conductor connection 542A-N and polished ground connections 544A-N. In an embodiment, the polished conductor connections 542A-N and the polished ground connections 544A-N are approximately flush with the port structure 250.

Figure 6A:
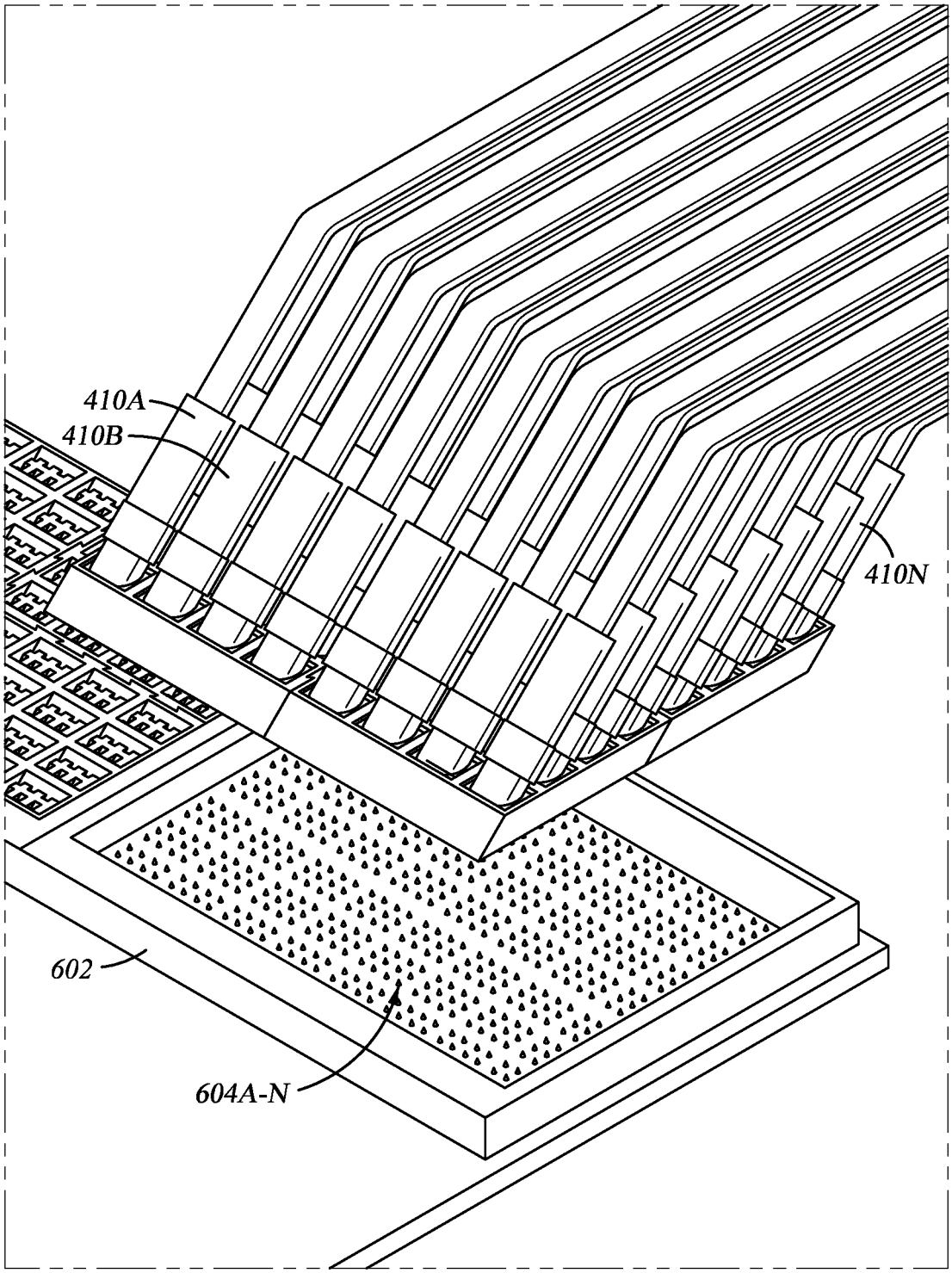
FIGS. 6A-B illustrate connecting twinax cables to the IC as part of a pinless interconnect, according to one embodiment.

FIG. 6A illustrates connecting twinax cables to the IC using spring pins as part of a pinless interconnect, according to one embodiment. In an embodiment, a number of twinax cables 410A-N connect to an IC using a port structure 250 and a socket structure 602. For example, as discussed above in relation to FIGS. 1A-B, an IC can include a number of sockets (e.g., the sockets 112A-N illustrated in FIGS. 1A-B). One or more of those sockets can include a socket structure 602 with a number of spring pins 604A-N.

The socket structure 602 can be connected to a grid of twinax cables using a port structure 250. The socket structure 602 can further connect directly to the IC. For example, the socket structure 602 can be integral to a package for the IC (e.g., to a printed circuit board (PCB)). This is merely on example, and the socket structure 602 can connect to an IC using any suitable technique.

In an embodiment, the port structure 250 includes contacts (e.g., electrical contacts) on a side facing the socket structure 602. For example, the port structure can include conductor connections (e.g., the polished conductor connections 542A-N illustrated in FIG. 5D) for conductors in the twinax cables 410A-N, and ground connections (e.g., the polished ground connections 544A-N illustrated in FIG. 5D). The conductor connections and ground connections can each interface with a respective spring pin, among the spring pins 604A-N. This can provide a connection (e.g., an electrical connection) between the socket structure 602 (and an IC to which the socket structure 602 is connected) and the twinax cables 410A-N.

Figure 6B:
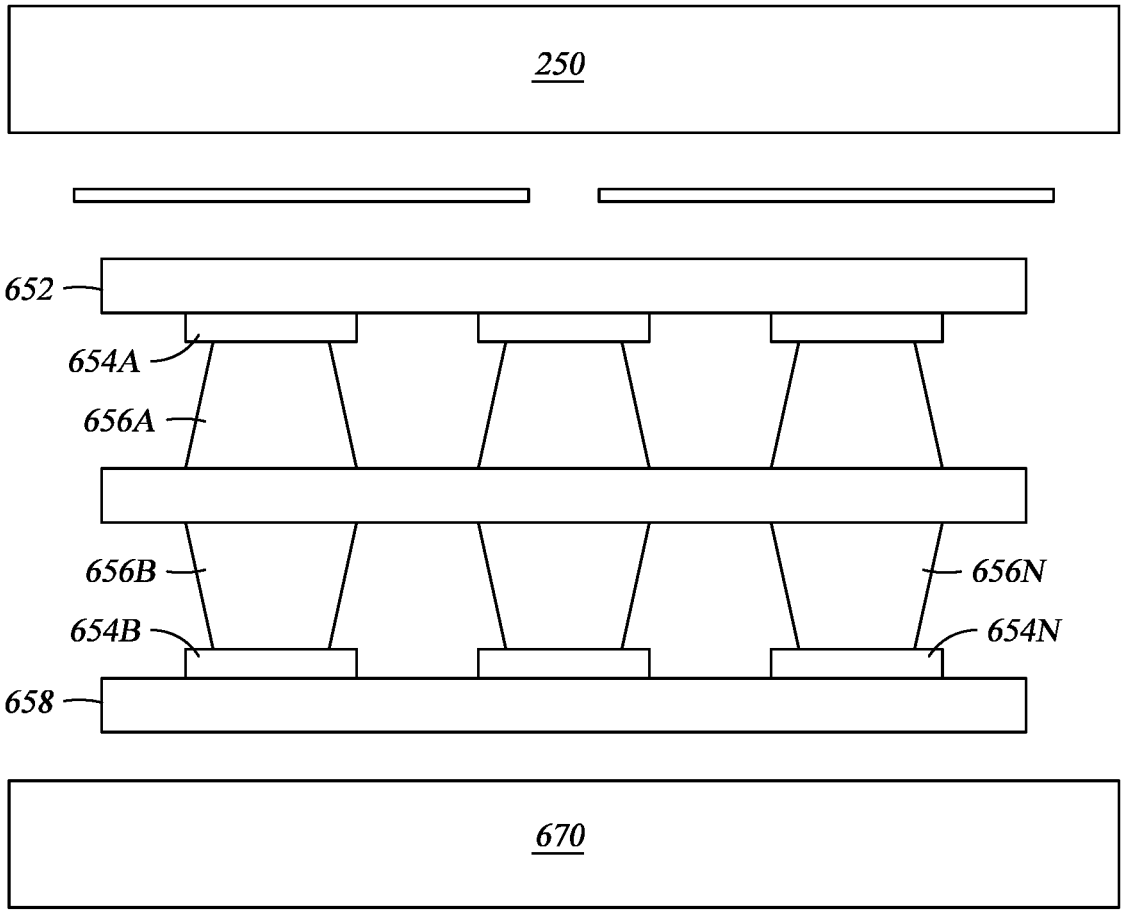

FIG. 6B illustrates polymer pins on an IC package for connecting twinax cables to the IC using a pinless interconnect, according to one embodiment. As discussed above in relation to FIG. 6A, in an embodiment, a port structure 250 connects to a socket structure 602 using spring pins 604A-N. This is merely one example connection techniques. Alternatively, or in addition, a port structure connects to the socket structure 602 using an elastomer socket.

For example, a cable terminating structure 652 can interface with a port structure (e.g., the port structure 250 illustrated in FIG. 6A) to connect with a number of twinax cables (e.g., using conductor connections 542A-N and ground connections 544A-N illustrated in FIG. 5D). An IC terminating structure 658 can interface with an IC 670 (e.g., an IC packager or PCB).

In an embodiment, a connection (e.g., an electrical connection or an optical connection) can be formed between the cable terminating structure 652 and the IC terminating structure 658 by compressing polymer pins 656A-N. For example, each connection in a port structure 250 (e.g., each conductor connection 542A-N and ground connection 544A-N illustrated in FIG. 5D) can contact a respective pad among a number of pads 654A-N. The polymer pins 656A-N can be compressed (e.g., by exerting a force to compress the cable terminating structure 652 toward the IC terminating structure), creating a connection between respective pairs of pads 654A-N, through the pins 656A-N, and between the port structure 250 and the IC 670.

Figure 7:
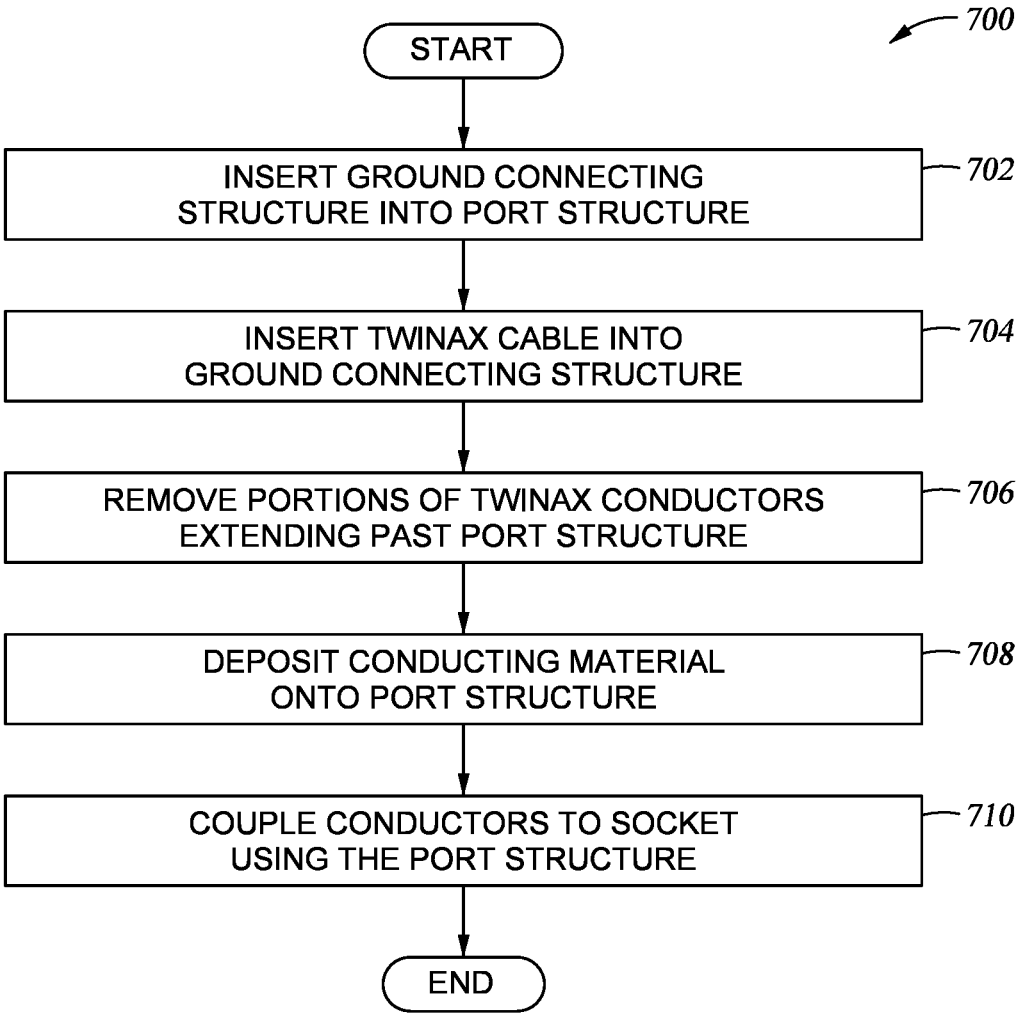
FIG. 7 is a flowchart illustrating connecting a twinax cable to an IC using a ground connecting structure for pinless interconnect, according to one embodiment.

FIG. 7 is a flowchart 700 illustrating connecting a twinax cable to an IC using a ground connecting structure for pinless interconnect, according to one embodiment. At block 702, a ground connecting structure is inserted into a port structure. For example, as discussed above in relation to FIGS. 3A-G, a ground connecting structure 310 can be inserted into a port structure 250.

At block 706, a twinax cable is inserted into the ground connecting structure. For example, as discussed above in relation to FIGS. 4A-B, a twinax cable 410 can be inserted into a ground connecting structure 310. At block 704, portions of conductor in the twinax cable that extend past the port structure can be removed. For example, as discussed above in relation to FIG. 5A, protruding conductor portions 512A-N can be removed (e.g., using a laser cutting tool).

At block 708, conducting material (e.g., a metal) is deposited onto the port structure. For example, as discussed above in relation to FIGS. 5C-D, conductor connections 532A-N (e.g., for conductors 420 in the twinax cable structures 410A-N illustrated in FIG. 4A) are formed by depositing a conducting material (e.g., a metal) onto a contact side of the port structure.

At block 710, the twinax cable conductors are coupled to a socket for an IC using the port structure. For example, as discussed above in relation to FIGS. 6A-B, twinax cables 410A-N can be coupled to a socket 602 structure (e.g., using spring pins or polymer pins). In an embodiment, as discussed above in relation to FIGS. 5D and 6A-B, this establishes an electrical connection between the twinax cables and the IC.

Figure 8:
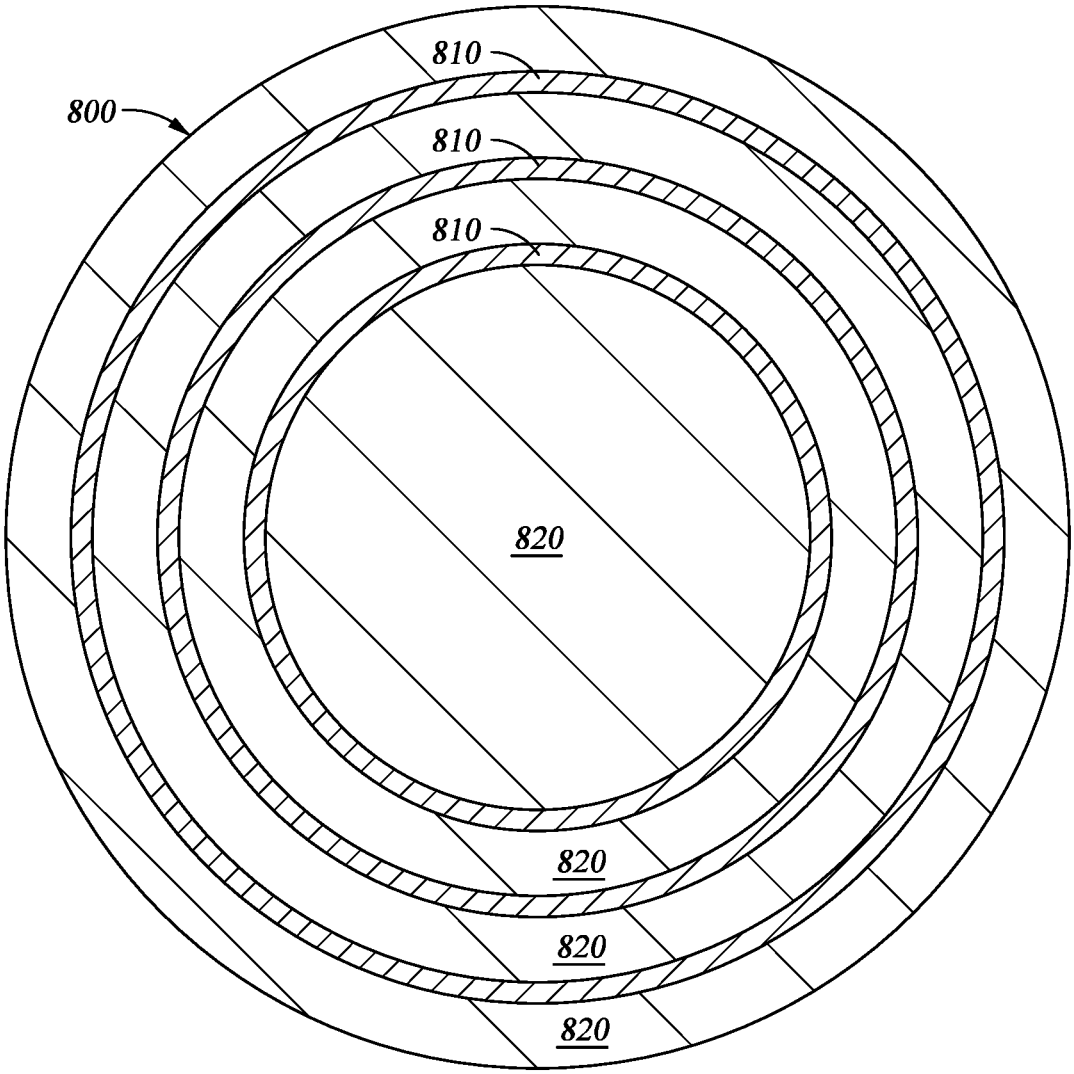
FIG. 8 illustrates a carbon layer for a twinax cable structure for pinless interconnect to an IC, according to one embodiment.

FIG. 8 illustrates a carbon layer for a twinax cable structure for pinless interconnect to an IC, according to one embodiment. In an embodiment, one or more carbon layers can be used with one or more copper layers in a conductor portion of a twinax cable structure, to connect to an IC. Each carbon layer can include graphite, graphene, or any suitable carbon material. In an embodiment, use of one or more carbon layers can improve conductivity and reduce conductor loss. For example, conductivity of a copper sheet is enhanced by the addition of a thinly applied layer of carbon, such as graphite or graphene, to a surface of the copper sheet. This is discussed further in U.S. Pat. No. 11,202,368 (the "'368 patent"), herein incorporated by reference for its discussion of the use of carbon layers with copper layers to enhance conductivity for connection to a printed circuit board (PCB).

For example, element 800 illustrates a cross-sectional view of a conductor including multiple carbon layers 810 and multiple copper layers 820. Each carbon layer 810 can be made of graphite or graphene, among other suitable carbon materials, and each carbon layer can have any number of atomic layers (e.g., any number of atomic graphite or graphene layers). Further, the conductor 800 can include any suitable number of carbon layers 810 and any number of copper layers 820. As discussed in the '368 patent, a given copper layer can have a thickness ranging from about 0.35 mil to about 5.0 mils (e.g., no greater than about 2 mils), or about 0.25 oz/ft$^2$to about 4 oz/ft$^2$ (e.g., no greater than about 1.75 oz/ft$^2$), with a graphite layer applied to a surface of the copper layer. The graphite layer can have a thickness that is much less than the thickness of the copper foil sheet (e.g., a thickness that is less than 0.35 mil) and is applied directly on and substantially or entirely covers the surface of the copper foil sheet . When utilizing graphene, the thickness of a graphene layer is also less than that of the copper foil layer (e.g., from about 2.5 Angstroms to about 5.0 Angstroms, depending upon whether the graphene layer is a monolayer or bilayer). These are merely examples, and any suitable copper layers and carbon layers can be used.

In an embodiment, the conductor 800 could be used for each of the conductors 420 illustrated in FIG. 4A. Each conductor 420 can be made up of multiple carbon layers (e.g., multiple graphite or graphene layers) and multiple copper layers. As discussed above, the use of the carbon layers can enhance the conductivity of the conductors 420. This is merely an example, and the conductor 800 can be used in any suitable component.

In the current disclosure, reference is made to various embodiments. However, the scope of the present disclosure is not limited to specific described embodiments. Instead, any combination of the described features and elements, whether related to different embodiments or not, is contemplated to implement and practice contemplated embodiments. Additionally, when elements of the embodiments are described in the form of "at least one of A and B," or "at least one of A or B," it will be understood that embodiments including element A exclusively, including element B exclusively, and including element A and B are each contemplated. Furthermore, although some embodiments disclosed herein may achieve advantages over other possible solutions or over the prior art, whether or not a particular advantage is achieved by a given embodiment is not limiting of the scope of the present disclosure. Thus, the aspects, features, embodiments and advantages disclosed herein are merely illustrative and are not considered elements or limitations of the appended claims except where explicitly recited in a claim(s). Likewise, reference to "the invention" shall not be construed as a generalization of any inventive subject matter disclosed herein and shall not be considered to be an element or limitation of the appended claims except where explicitly recited in a claim(s).

As will be appreciated by one skilled in the art, the embodiments disclosed herein may be embodied as a system, method or computer program product. Accordingly, embodiments may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, embodiments may take the form of a computer program product embodied in one or more computer readable medium(s) having computer readable program code embodied thereon.

Program code embodied on a computer readable medium may be transmitted using any appropriate medium, including but not limited to wireless, wireline, optical fiber cable, RF, etc., or any suitable combination of the foregoing.

Computer program code for carrying out operations for embodiments of the present disclosure may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present disclosure are described herein with reference to flowchart illustrations and/or block diagrams of methods, apparatuses (systems), and computer program products according to embodiments presented in this disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the block(s) of the flowchart illustrations and/or block diagrams.

These computer program instructions may also be stored in a computer readable medium that can direct a computer, other programmable data processing apparatus, or other device to function in a particular manner, such that the instructions stored in the computer readable medium produce an article of manufacture including instructions which implement the function/act specified in the block(s) of the flowchart illustrations and/or block diagrams.

The computer program instructions may also be loaded onto a computer, other programmable data processing apparatus, or other device to cause a series of operational steps to be performed on the computer, other programmable apparatus or other device to produce a computer implemented process such that the instructions which execute on the computer, other programmable data processing apparatus, or other device provide processes for implementing the functions/acts specified in the block(s) of the flowchart illustrations and/or block diagrams.

The flowchart illustrations and block diagrams in the Figures illustrate the architecture, functionality, and operation of possible implementations of systems, methods, and computer program products according to various embodiments. In this regard, each block in the flowchart illustrations or block diagrams may represent a module, segment, or portion of code, which comprises one or more executable instructions for implementing the specified logical function(s). It should also be noted that, in some alternative implementations, the functions noted in the block may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustrations, and combinations of blocks in the block diagrams and/or flowchart illustrations, can be implemented by special purpose hardware-based systems that perform the specified functions or acts, or combinations of special purpose hardware and computer instructions.

In view of the foregoing, the scope of the present disclosure is determined by the claims that follow.

We claim:

1. A system, comprising:

a socket coupled to an integrated circuit (IC);

a port structure coupled to the socket;

a ground connector inserted into the port structure; and a twinaxial cable comprising a pair of conductors inserted through the ground connector to establish an electrical connection between the twinaxial cable and the IC.

2. The system of claim 1, further comprising:

a strain relief structure configured to relieve strain on the twinaxial cable inserted into the ground connector, the strain relief structure comprising:

a sleeve covering a join between the twinaxial cable and the ground connector; and the ground connector.

3. The system of claim 1, wherein each of the conductors in the pair of conductors comprises a plurality of copper layers and a plurality of carbon layers, each of the carbon layers comprising one of: (i) graphite or (ii) graphene.

4. The system of claim 1, wherein the pair of conductors is electrically coupled to the socket using at least one of: (i) one or more spring pins on the socket and (ii) one or compressed polymer pins on the socket.

5. The system of claim 1, wherein the pair of conductors pass through one or more receptacles in the ground connector and a respective pair of openings in the port structure to establish the electrical connection with the IC through the socket.

6. The system of claim 5, wherein the port structure further comprises a conducting material deposited into the respective pair of openings at a location between the pair of conductors and the socket, and wherein the electrical connection is established between the socket and the twinaxial cable through deposited conducting material.

7. The system of claim 5, further comprising:

a plurality of port structures coupled to the socket;

a plurality of ground connectors each independently inserted into a respective port structure, of the plurality of port structures; and a plurality of twinaxial cables, each twinaxial cable comprising a respective pair of conductors inserted into a respective ground connector of the plurality of ground connectors.

8. The system of claim 7, wherein the plurality of port structures comprises a first grid of port structures, and wherein the grid of port structures comprises one or more latching structures configured to attach the first grid of port structures to a second grid of port structures.

9. The system of claim 7, wherein each of the ground connectors is inserted into the respective port structure at an angle less than 90 degrees relative to a surface of the port structure.

10. The system of claim 7, wherein each port structure comprises an insulating material and each ground connector comprises a conducting material coupled to a conducting portion of the respective twinaxial cable.

11. The system of claim 10, wherein the insulating material is a plastic material, wherein the conducting material is a metal material, and wherein the conducting portion of the respective twinaxial cable comprises a shield portion of the respective twinaxial cable.

12. An apparatus, comprising:

a port structure, wherein the port structure is configured to be coupled to a socket for an integrated circuit (IC); and a ground connector inserted into the port structure, wherein the ground connector comprises a receptacle configured to receive a twinaxial cable and one or more openings configured to allow a pair of conductors for the twinaxial cable to pass through the ground connector to establish an electrical connection for the twinaxial cable.

13. The apparatus of claim 12, wherein the port structure further comprises a conducting material deposited at a location between the pair of conductors and the socket, and wherein the electrical connection is established between the socket and the twinaxial cable through deposited conducting material.

14. The apparatus of claim 12, wherein the port structure comprises an insulating material and the ground connector comprises a conducting material coupled to a conducting portion of the twinaxial cable.

15. The apparatus of claim 12, further comprising:

a strain relief structure configured to relieve strain when the twinaxial cable is inserted into the ground connector, the strain relief structure comprising the ground connector and a sleeve configured to cover a join between the twinaxial cable and the ground connector.

16. A method, comprising:

inserting a ground connector into a port structure;

inserting a twinaxial cable into the ground connector, wherein the twinaxial cable comprises a pair of conductors passing through the ground connector and the port structure; and coupling the pair of conductors to a socket for an integrated circuit using the port structure, wherein the coupled pair of conductors provides an electrical connection between the twinaxial cable and the IC.

17. The method of claim 16, wherein coupling the pair of conductors to the socket coupled to an integrated circuit further comprises:

removing a portion of at least one of the pair of conductors that extends past the port structure; and depositing a conducting material onto the port structure to provide the electrical connection between the twinaxial cable and the IC.

18. The method of claim 17, wherein depositing the conducting material onto the port structure to provide the electrical connection between the twinaxial cable, the method further comprising:

depositing the conducting material onto the port structure to establish ground connections for the port structure.

19. The method of claim 16, further comprising:

forming a first grid of port structures by connecting a plurality of port structures, each port structure configured to receive a respective ground connector and twinaxial cable.

20. The method of claim 19, further comprising:

connecting the first grid of port structures to a second grid of port structures using one or more latching structures relating to the first and second port structures.

* * * * *